US005858593A

United States Patent [19]

Tamura et al.

[11] Patent Number: 5,858,593

[45] Date of Patent: Jan. 12, 1999

[54] MAGNETIC TONER, APPARATUS UNIT AND IMAGE FORMING METHOD

[75] Inventors: Osamu Tamura, Kashiwa; Koichi Tomiyama, Numazu; Nobuyuki Okubo, Yokohama; Shunji Suzuki, Tokyo; Yoshihiro Ogawa, Numazu; Keita Nozawa, Shizuoka-ken, all of Japan

[73] Assignee: Canon Kabushiki Kaisha, Tokyo, Japan

[21] Appl. No.: 902,323

[22] Filed: Jul. 29, 1997

[30] Foreign Application Priority Data

Jul. 31, 1996 [JP] Japan ..... 8-216860
Jul. 17, 1997 [JP] Japan ..... 9-192234

[51] Int. Cl.[6] ..... G03G 9/083; G03G 13/09; G03G 15/09

[52] U.S. Cl. ..... 430/106.6; 430/122; 430/111; 399/267

[58] Field of Search ..... 430/106.6, 111, 430/122

[56] References Cited

U.S. PATENT DOCUMENTS

| | | | |
|---|---|---|---|
| 4,959,692 | 9/1990 | Hayashi et al. | 399/234 |
| 5,215,845 | 6/1993 | Yusa et al. | 430/106.6 |
| 5,307,122 | 4/1994 | Ohno et al. | 430/106.6 |
| 5,525,752 | 6/1996 | Izumizaki et al. | 399/275 |
| 5,731,122 | 3/1998 | Yoshida et al. | 430/126 |

FOREIGN PATENT DOCUMENTS

| | | |
|---|---|---|
| 0395026 | 10/1990 | European Pat. Off. . |
| 0427275 | 5/1991 | European Pat. Off. . |
| 0681218 | 11/1995 | European Pat. Off. . |
| 0699963 | 3/1996 | European Pat. Off. . |
| 0701177 | 8/1996 | European Pat. Off. . |
| 1-112253 | 4/1989 | Japan . |
| 1-191156 | 8/1989 | Japan . |
| 1-219756 | 9/1989 | Japan . |
| 2-214156 | 8/1990 | Japan . |
| 2-284158 | 11/1990 | Japan . |
| 3-181952 | 8/1991 | Japan . |
| 4-162048 | 6/1992 | Japan . |
| 8-101529 | 4/1996 | Japan . |

*Primary Examiner*—Roland Martin
*Attorney, Agent, or Firm*—Fitzpatrick, Cella, Harper & Scinto

[57] ABSTRACT

Disclosed are a magnetic toner for developing an electrostatic latent image comprising magnetic toner particles containing a binder resin of 100 parts by weight and a magnetic substance of 20 to 150 parts by weight, and an apparatus unit and an image forming method for employing the magnetic toner. A frictional electrification property is such that the absolute value of the frictional electrification amount relative to an iron powder of 250 mesh-pass to 350 mesh-on is 25 to 40 mc/kg. Assuming that for particle distribution of the magnetic toner a weight-average particle diameter ($D_4$) for the magnetic toner is X ($\mu$m) and that a count % in a count distribution of magnetic toner particles that have a diameter of 3.17 $\mu$m or smaller is Y (%), expressions (1) and (2) are satisfied:

$$-5X+35 \leqq Y \leqq -25X+180 \quad (1)$$

$$3.5 \leqq X \leqq 6.5 \quad (2).$$

Sphericity ($\psi$) of particles is equal to or greater than 0.80 and a product ($\sigma_r \times H_c$) of remanence [$\sigma_r$ ($Am^2/kg$)] and coercive force ($H_c$ (kA/m)] of the magnetic substance in a magnetic field of 795.8 kA/m (10 k oersted) is 10 to 56 ($kA^2m/kg$).

66 Claims, 8 Drawing Sheets

MAGNETIC TONER, APPARATUS UNIT AND IMAGE FORMING METHOD

BACKGROUND OF THE INVENTION

1. Field of the Invention

The present invention relates to a magnetic toner and an apparatus unit for developing an electrostatic latent image, and an image forming method therefor.

2. Related Background Art

Conventionally, there are many well known electrophotographic methods. Generally, an electric latent image is formed on an image bearing member (photosensitive member) by various means using an optical conductive material, and the latent image is developed by toner to form a toner image and is transferred to a transfer member, such as a paper sheet, as needed, the toner image being fixed to the transfer member by heat or pressure or by heat and pressure to provide a duplicate or a printed material.

Presently, there are various types of devices that use electrophotographic methods, such as copy machines, printers and facsimile machines.

As for printers, for example, LED or LBP printers are a recent trend on the market. Technically, resolutions of printers are increased from conventional 240 or 300 dpi to 400, 600 or 800 dpi. Accordingly, a more detailed development method is required. Also, copy machines tend to have higher functions, so that they are gradually digitized. Since digital copy machines mainly employ a method for forming an electrostatic latent image using a laser beam, the resolutions are increased, and a more detailed development method is required for digital copy machines as well as printers.

Toners having a small particle diameter for which a specific particle distribution is employed have been proposed in Japanese Patent Application Laid-Open Nos. 1-112253, 1-191156, 2-214156, 2-284158, 3-181952 and 4-162048.

When printing is performed using these toners, however, still many toner particles are still scattered around a character line, and an improvement in character line definition or sharpness is required.

Although the character line definition is somewhat improved when a toner having a smaller particle diameter is used, there is a deterioration of flowability of the toner, and a reduction in the density provided for a solid black image is especially noticeable. In addition, as a consequence of the reduction in the diameter of toner particles, fogging tends to occur in a non-image portion.

A preferable magnetic toner having a smaller particle diameter is proposed in Japanese Patent Application Laid-Open No. 1-219756, but requires further improvement for the maintenance of image density and of fogging control.

In addition, in Japanese Patent Application Laid-Open No. 8-101529 (related application: EP-A 0699963) is proposed a magnetic toner containing magnetic fine particles such that a product ($\sigma_r \times H_c$) of remanence ($\sigma_r$[$Am^2$/kg]) and coercive force ($H_c$[kA/m]) in a magnetic field of 79.58 kA/m (1 k oersted) is 60 to 250[$kA^2m$/kg]. For the magnetic fine particles that are described in Japanese Patent Application Laid-Open No. 8-101529, a product ($\sigma_r \times H_c$) in a magnetic field of 79.58 kA/m (1 k oersted) is 60 to 250[$kA^2m$/kg], while a product ($\sigma_r \times H_c$) in a magnetic field of 795.8 kA/m (10 k oersted) is approximately 66 to 275[$kA^2m$/kg], and magnetic fine particles having the shape of a hexahedron or an octahedron (generally, a sphericity ($\psi$) of less than 0.75) are preferably employed. Since the frictional electrification of the magnetic toner is low, −13.0 to −22.0 $\mu$c/g, on balance, it is not easy for a magnetic toner that includes a comparatively large number of magnetic toner particles having diameters of 3.17 $\mu$m or smaller to provide a high image density and to implement the suppression of fogging occurrences in a non-image portion, and thus, further improvement of the magnetic toner is required.

SUMMARY OF THE INVENTION

It is one object of the present invention to provide a magnetic toner, for developing an electrostatic latent image, that can overcome the above problems.

It is another object of the present invention to provide a magnetic toner, for developing an electrostatic latent image, with which no toner scattering occur along a line image and a character image that are formed and with which a sharply defined toner image can be formed.

It is an additional object of the present invention to provide a magnetic toner, for developing an electrostatic latent image, with which a preferable toner image can be formed in any environments.

It is a further object of the present invention to provide magnetic toner, for developing an electrostatic latent image, with which fogging seldom occurs, especially in a low-temperature and low-humidity environment, and with which a toner image having a high image density can be formed.

It is a still further object of the present invention to provide an apparatus unit that employs the above magnetic toner and that can be detached from a main body of an image forming apparatus.

It is yet another object of the present invention to provide an image forming method employing the above magnetic toner.

To achieve the above objects, according to the present invention, provided is a magnetic toner, for developing an electrostatic latent image, comprising magnetic toner particles consisting of a binder resin of 100 parts by weight and a magnetic substance of 20 to 150 parts by weight, wherein a frictional electrification property is such that the absolute value of the frictional electrification amount relative to an iron powder of 250 mesh-pass to 350 mesh-on is 25 to 40 mc/kg;

assuming that for particle distribution of the magnetic toner a weight-average particle diameter ($D_4$) of the magnetic toner is X ($\mu$m), and that a % by number in a number distribution of magnetic toner particles that have a diameter of 3.17 $\mu$m or smaller is Y (%), expressions (1) and (2) are satisfied:

$$-5X+35 \leqq Y \leqq -25X+180 \quad (1)$$

$$3.5 \leqq X < 6.5 \quad (2)$$

sphericity ($\psi$) of the magnetic substance is equal to or greater than 0.80; and a product ($\sigma_r \times H_c$) of remanence [$\sigma_r$ ($Am^2$/kg)] and coercive force [$H_c$ (kA/m)] of the magnetic substance in a magnetic field of 795.8 kA/m (10 k oersted) is 10 to 56 ($kA^2m$/kg).

Further, to achieve the above objects, according to the present invention, provided is an apparatus unit that is capable of being detached from a main body of an image forming apparatus, comprising a development unit having a container in which frictional electrification magnetic toner is held, a development sleeve for feeding the magnetic toner, and a toner layer thickness regulating member for coating the toner on the development sleeve while pressing the development sleeve, wherein the magnetic toner is composed of magnetic toner particles containing a magnetic substance of 20 to 150 parts by weight for a binder resin of 100 parts by weight;

the magnetic toner has a frictional electrification property whereof an absolute value for a frictional electrification amount relative to iron powder of 250 mesh-pass to 350 mesh-on is 25 to 40 mc/kg;

assuming that a weight-average particle diameter ($D_4$) of the magnetic toner in a particle distribution of the magnetic toner is X ($\mu$m) and that a % by number in a number distribution of the magnetic toner particles that have a diameter of 3.17 $\mu$m or smaller is Y (%), expressions (1) and (2) are satisfied $$-5X+35 \leqq Y \leqq -25X+180 \quad (1)$$

$$3.5 \leqq X \leqq 6.5 \quad (2)$$

sphericity of the magnetic substance is 0.80 or greater and a product ($\sigma_r \times H_c$) of remanence [$\sigma_r$ ($Am^2/kg$)] and coercive force [$H_c$ (kA/m)] of the magnetic substance in a magnetic field of 795.8 kA/m (10 k oersted) is 10 to 56 ($kA^2m/kg$);

in the development sleeve is provided a fixed magnet, which has at least a first magnetic pole of 520 to 870 gauss that is positioned opposite a magnetic toner mixing member located in the container, a second magnetic pole of 600 to 950 gauss that is positioned opposite the toner layer thickness regulating member, and a third magnetic pole of 700 to 1000 gauss that is a development magnetic pole; and a center line roughness ($R_a$) of a surface of the development sleeve is 0.3 to 2.5 $\mu$m.

In addition, to achieve the above objects, according to the present invention, provided is an image forming method, comprising the steps of:

charging an electrostatic latent image bearing member by using charging means, forming an electrostatic latent image by exposing the charged electrostatic latent image bearing member, developing the electrostatic latent image to form a magnetic toner image by using a development apparatus, which is positioned opposite the electrostatic latent image bearing member, transferring the magnetic toner image to a transfer material by using or without using an intermediate transfer member, and fixing the magnetic toner image to the transfer material;

wherein the development apparatus has a container in which frictional electrification magnetic toner is retained, a development sleeve for feeding the magnetic toner, and a toner layer thickness regulating member for coating the magnetic toner on the development sleeve while pressing against the development sleeve;

the magnetic toner is composed of magnetic toner particles containing a magnetic substance of 20 to 150 parts by weight for a binder resin of 100 parts by weight;

the magnetic toner has a frictional electrification property such that the absolute value of a frictional electrification amount relative to iron powder of 250 mesh-pass to 350 mesh-on is 25 to 40 mc/kg;

assuming that weight-average particle diameter ($D_4$) of the magnetic toner in a particle distribution of the magnetic toner is X ($\mu$m) and that % by number in a number distribution of the magnetic toner particles having a diameter of 3.17 $\mu$m or smaller is Y (%), expressions (1) and (2) below are satisfied $$-5X+35 \leqq Y \leqq -25X+180 \quad (1)$$

$$3.5 \leqq x < 6.5 \quad (2)$$

sphericity ($\psi$) of the magnetic substance is 0.80 or greater and a product ($\sigma_r \times H_c$) of remanence [$\sigma_r$ ($Am^2/kg$)] and coercive force [$H_c$ (kA/m)] of the magnetic substance in a magnetic field of 795.8 kA/m (10 k oersted) is 10 to 56 ($kA^2m/kg$);

in the development sleeve is provided a fixed magnetic, which has at least a first magnetic pole of 520 to 870 gauss that is positioned opposite a magnetic toner mixing member located in the container, a second magnetic pole of 600 to 950 gauss that is positioned opposite the toner layer thickness regulating member, and a third magnetic pole of 700 to 1000 gauss that is a development magnetic pole; and a center line roughness ($R_a$ ) of a surface of the development sleeve is 0.3 to 2.5 $\mu$m.

DETAILED DESCRIPTION OF THE PREFERRED EMBODIMENTS

Figure 4:
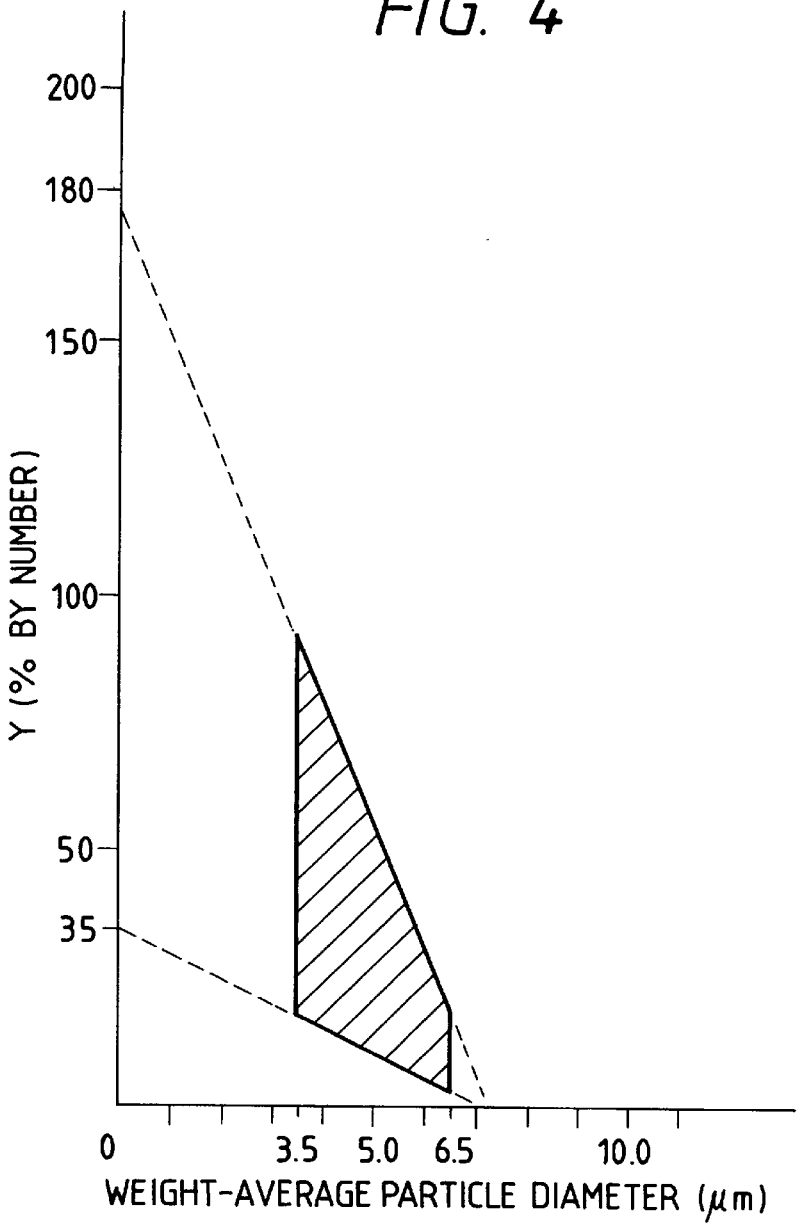
FIG. 4 is a graph showing the range for Y (% by number) for a magnetic toner of the present invention.

Magnetic toner according to the present invention must satisfy the following expressions (1) and (2)

$$-5X+35 \leqq Y \leqq -25X+180 \quad (1)$$

$$3.5 \leqq X \leqq 6.5 \quad (2)$$

for which it is assumed that the weight-average particle diameter ($D_4$) in the particle distribution of the magnetic toner is X (μm), and that % by number in the number distribution having a diameter of 3.17 μm or smaller is Y (%). In this invention, when Y>−25X+180, fogging occurs easily, and when Y<−5X+35, deterioration of character line definition occurs, so that neither case is preferable. When X>3.5, deterioration of the image density occurs, and when X>6.5, deterioration of character line definition occurs, so that neither case is preferable. The range for Y (% by number) of the magnetic toner of the present invention is shown as a shaded portion in FIG. 4.

To more precisely implement the above action effect, it is more desirable that X be 4.0 to 6.3 and that the following expression (3) concerning Y (%) be satisfied:

$$-5X+35 \leqq Y \leqq -12.5X+98.75 \quad (3)$$

In addition, when % by number in number distribution of toner particles having a diameter of 2.52 μm or smaller is Z (%), it is preferable that the magnetic toner of the present invention satisfy following expression (4):

$$-7.5X+45 \leqq Z \leqq -12.0X+82 \quad (4)$$

When the magnetic toner satisfies expression (4), the definition of characters and line images is enhanced, and fogging and deterioration of image density seldom occur.

For the measurement of particle distribution in the magnetic toner of the present invention, a Coulter counter-TA-II or a Coulter multisizer (Coulter Co., Ltd.) is employed, and first-grade sodium chloride is used as an electrolytic solution to adjust a 1% NaCl aqueous solution. ISOTON R-II (Coulter Scientific Japan Co., Ltd.), for example, can be employed. For the measurement, initially 0.1 to 5 ml of a surface active agent (preferably alkylbenzene sulfonate) is added as a disperser to an electrolytic aqueous solution of 100 to 150 ml, and then a determination sample of 2 to 20 mg is added thereto. A dispersion process for the electrolytic suspension is performed by employing an ultrasonic dispersion device for about 1 to 3 minutes. The volume of the toner and the number of the toner particles that are 2 μm or greater are obtained by using an aperture of 100 μm for the measurement device that is employed. In this fashion, the volume distribution and the number distribution are acquired. Then, the weight-average particle diameter ($D_4$: the center value of each channel is defined as a representative value for each channel) of a weight standard is acquired from the volume distribution for the present invention, and the number standard of 3.17 μm or smaller and the number standard of 2.52 μm or smaller are acquired from the number distribution. Following this, the ratio of the weight-average particle diameter to the number standard is calculated.

It is preferable, for the magnetic toner of the present invention, that a product ($\sigma_r \times H_c$) of the remanence ($\sigma_r$) of a magnetic substance and coercive force ($H_c$) in a magnetic field of 795.8 kA/m be 10 to 56 $kA^2m/kg$ (desirably, 24 to 56 $kA^2Am/kg$, and more desirably, 30 to 52 $kA^2m/kg$).

When a magnetic substance of the present invention is employed for which, for magnetic toner particles within a specific small diameter range, the product of $\sigma_r \times H_c$ is smaller than 10 $kA^2m/kg$ is employed, fogging tends to occur, especially in a low-temperature/low-humidity environment. When a magnetic substance is employed for which the product of $\sigma_r \times H_c$ is greater than 56 $kA^2m/kg$, line characters and line images tend to be thinner and image density tends to be deteriorated.

In the present invention, the magnetic characteristic is measured in an external magnetic field of 795.8 kA/m by using VSMP-1-10 (Toei Industry Co., Ltd.). For the magnetic toner of the present invention, a magnetic substance having a sphericity (ψ) of 0.80 or greater (more desirably, 0.85 or greater) is employed.

When the sphericity of the particles of the magnetic substance is smaller than 0.80, the individual particles contact each other at their faces. As small magnetic particles having a diameter of 0.05 to 0.30 μm can not be separated by the available mechanical shear force, a cohesive body easily occurs, and satisfactory dispersal of the magnetic substance be in a binder resin is not possible. As a result, a difference in the characteristics of the magnetic toner particles tends to be caused, the image density is easily deteriorated, and fogging tends to occur.

It is preferable that a magnetic substance containing silicon elements be employed for the magnetic toner of the present invention. The silicon element content of the magnetic substance is preferably 0.1 to 4.0% by weight relative to iron elements used as a reference.

When the silicon element content is smaller than 0.1% by weight, a product of the remanence ($\sigma_r$) and the coercive force ($H_c$) tends to be increased and character images and line images tend to be thinned. In addition, fogging tends to occur in a low-temperature/low-humidity environment.

When the silicon element content is greater than 4.0% by weight, a product of the remanence ($\sigma_r$) and the coercive force ($H_c$) tends to be decreased and fogging tends to occur. In addition, image density tends to be deteriorated in a high-temperature/high-humidity environment.

In order to accomplish the objects of the present invention at a higher level, it is preferable that the magnetic substance, on the surface, at least, contain silicon dioxide, and that, when the % by weight of the silicon dioxide on the surface is W (%) and number-average particle diameter in the particle distribution for the magnetic substance is R (μm), W×R satisfy a product of 0.003 to 0.042.

Since a value for W×R is determined, it is possible to more accurately identify whether $SiO_2$ is tightly bound or loosely bound to the surfaces of particles of the magnetic substance, which is measured by using the BET method.

Assuming that a specific surface area that is acquired from the average particle diameter of the magnetic substance is S and the density of the magnetic substance is ρ, $S=4\pi R^2\times[1/(4/3)\pi R^3\cdot\rho]=3/R\cdot\rho$. The condition where $SiO_2$ exists on the surface of the particles of the magnetic substance is actually given as $W/S=R\cdot W\cdot\rho/3$. Since a preferable range of W/S is $0.001\rho \leqq W/S \leqq 0.014\rho$, $0.001\rho \leqq R\cdot W\cdot\rho/3 \leqq 0.014\rho$, and when the expression is simplified, $0.003 \leqq W\times R \leqq 0.042$.

When W×R is smaller than 0.003, $SiO_2$ is bound very loosely to the surface of the magnetic particles. Thus, the effect that contributes to the flowability of the magnetic toner is reduced, and the deterioration of image density and the occurrence of fogging tend to occur in the low-temperature/low-humidity environment. When W×R is greater than 0.042, deterioration of the adhesion between the binder resin and the magnetic substance occurs, and the magnetic substance easily separates during the toner manufacturing procedure. Further, as a result, we assume, of this separation of the magnetic substance, drum fusion tends to occur. The more preferable range for W×R is 0.008 to 0.035.

It is more desirable that silicon dioxide present on the surface of the magnetic surface have 0.06 to 0.50% by weight, and that the number-average particle diameter of the magnetic substance be 0.05 to 0.30 μm.

It is desirable that the volume specific resistance of the magnetic substance be $1\times10^4$ to $1\times10^7$ Ω·cm (more desirably, $5\times10^4$ to $5\times10^6$ Ω·cm). This is because the frictional electrification amount of the magnetic toner is easily adjusted to an absolute value of 25 to 40 mC/kg, the frictional electrification amount of magnetic toner is reduced only a little in a high-temperature/high-humidity environment, and the charge-up of the magnetic toner in the low-temperature/low-humidity environment is restricted.

When the void ratio, at the time of tapping of the magnetic toner defined by the below expression, is within a range of 0.45 to 0.70, the employment of the magnetic toner of the present invention can satisfactorily prevent the reduction of density due to the charge-up, especially in a low-temperature/low-humidity environment.

Void ratio=(true density of magnetic toner −tap density of magnetic toner)/true density of magnetic toner Frictional electrification is performed for the magnetic toner mainly while it is packed between a development sleeve and a toner layer thickness regulating member (blade). Thus, the packing condition of the magnetic toner greatly affects the electrification of the magnetic toner. When the void ratio at the time of tapping, which is one index for the packing condition, is 0.45 to 0.70, like the range for the present invention, the magnetic toner is frictionally electrified in a condition wherein the magnetic toner is packed more loosely than it is conventionally. The condition where the magnetic toner is more loosely packed is preferable because the magnetic toner particles move easily on the development sleeve, and equal opportunities are available for electrifying magnetic toner particles that have different diameters.

The preferred magnetic substance that is used for the magnetic toner of the present invention will now be described in detail.

Magnetic metal oxides containing elements, such as iron, cobalt, nickel, copper, magnesium, manganese, aluminum and silicon, are employed for a magnetic substance that is used for the magnetic toner of the present invention. The number-average particle diameter of the magnetic substance is desirably 0.05 to 0.30 $\mu$m, and more desirably, 0.10 to 0.25 $\mu$m. It is not desirable for the number-average particle diameter to be smaller than 0.05 $\mu$m, because the color of the magnetic substance tends to be reddish and the color of the magnetic toner is reflected in the color of an image. Further, it is not desirable for the number-average particle diameter to be greater than 0.30 $\mu$m, because the latitude of an image density and the latitude of a fogging restriction condition can not be satisfactorily acquired.

The properties of the magnetic metal oxide can be adjusted by controlling the pH of an iron hydroxide aqueous solution, the fluid temperature, the velocity of air oxidation, and the amount of existing elements other than iron elements.

The binder resin used for the magnetic toner will now be explained.

Preferable binder resins for toner used in this invention are polystyrene; a polymer of a styrene substitution product, such as poly-p-chlorostyrene or polyvinyl toluene; a styrene copolymer, such as a styrene-p-chlorostyrene copolymer, a styrene-vinyltoluene copolymer, a styrene-vinyl naphthalin copolymer, a styrene-acrylic ester copolymer, a styrene-methacrylic ester copolymer, a styrene-α-chloromethacrylate methyl copolymer, a styrene-acrylonitrile copolymer, a styrene vinylmethyl ester copolymer, a styrene-vinylethyl ester copolymer, a styrene-vinylmethylketone copolymer, a styrene-butadiene copolymer, a styrene-isoprene copolymer, a styrene-acrylonitrile-indene copolymer; poly(vinyl chloride); phenol resin; naturally modified phenol resin; naturally modified maleate resin; acrylic resin; methacrylic resin; poly (vinyl acetate); silicone resin; polyester resin; polyurethane; polyamide resin; furan resin; epoxy resin; xylene resin; polyvinyl butyral; terpene resin; cumaroneindene resin; and petroleum resin. A cross-linking styrene resin is also a preferable binder resin.

Comonomers relative to styrene monomers of styrene series copolymers are monocarboxylic acid, or a substitution product that has double bonding, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile or acrylamide; dicarboxylic acid, or a substitution product that has double bonding, such as maleic acid, butyl maleate, methyl maleate, or dimethyl maleate; a vinyl ester, such as vinyl chloride, vinyl acetate or vinyl benzoate; olefins of an ethylene series, such as ethylene, propylene or butylene; vinyl ketone, such as vinylmethylketone or vinylhexylketone; and a vinylether, such as vinylmethyl ether, vinylethyl ether or vinylisobutyl ether. These vinyl monomers are employed by themselves or by combining them with a styrene monomer. A compound having double bonding whereby two or more polymerizations are possible is mainly employed as a cross-linking agent. For example, employed are an aromatic divinyl compound, such as divinyl benzene or divinyl naphthalane; a carboxylate ester having two double bondings, such as ethyleneglycol diacrylate, ethyleneglycol dimethacrylate, or 1,3-butanediol dimethancrylate; a divinyl compound, such as divinyl aniline, divinyl ether, divinyl sulfide or divinyl sulfone; and a compound having three or more vinyl groups. These compounds can be employed independently or as a mixture.

It is preferable that an organic metal compound be used as a charge controlling agent for the magnetic toner of the present invention. Organic metal compounds that contain, as a ligand or a counter ion, an organic compound having superior vaporization and sublimation characteristics are especially effective.

Azo metal complexes represented by following general chemical expressions are employed as the above metal complexes.

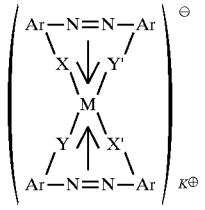

or

-continued

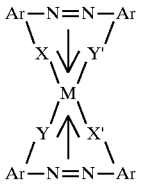

Wherein, M denotes a coordination central metal, such as Cr, Co, Ni, Mn, Fe, Al, Ti or Sc, which have a coordination number of 6; Ar denotes an aryl group, such as the phenyl group or the naphthyl group, and may contain a substituent, in which the substituent groups are the nitro group, the halogen group, the carboxyl group, the anilide group and the alkyl group, which have a carbon number of 1 to 18, or the alkoxyl group; X, X', Y and Y' denote —O—, —CO—, —NH— and —NR— (R is the alkyl group that has a carbon number of 1 to 4); $K^+$denotes a hydrogen ion, a sodium ion, a potassium ion, an ammonium ion or an aliphatic ammonium ion, or a mixture of their ions.

A specific example of a preferable complex that is employed for the present invention is shown below.

Expression (a)

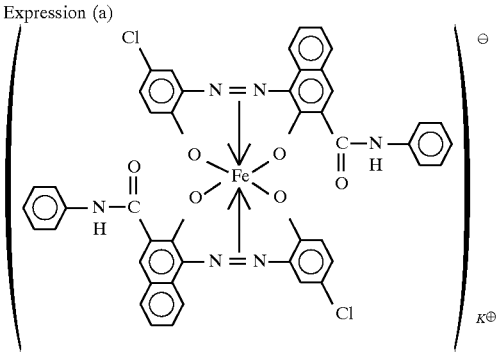

[$K^+$ denotes $H^+$, $Na^+$, $K^+$, $NH_4^+$ or an aliphatic ammonium ion, or a mixture of their ions.]

Expression (b)

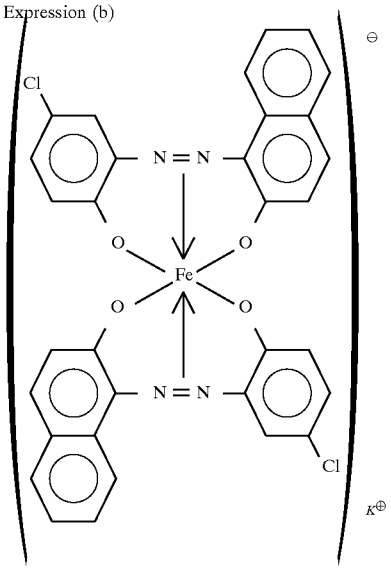

[$K^+$ denotes $H^+$, $Na^+$, $K^+$, $NH_4^+$ or an aliphatic ammonium ion, or a mixture of their ions.]

Expression (c)

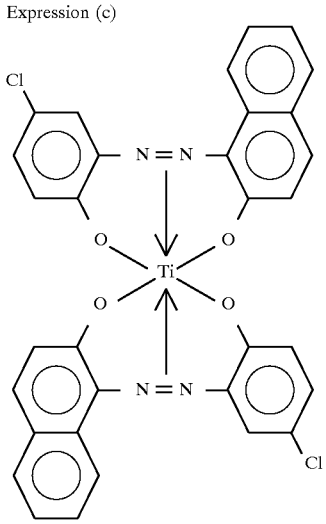

Preferably, the amount of the compound that is added is within the range 0.2 to 5 parts by weight relative to a binder resin of 100 parts by weight.

It is preferable that wax be added to the magnetic toner of the present invention. Such wax is paraffin wax and its derivative, microcrystalline wax and its derivative, Fischer-Tropsch wax and its derivative, polyolefin wax and its derivative, or carnauba wax and its derivative. The derivative is an oxide, a block copolymer with a vinyl monomer, or a graft-modified material.

The preferable wax for employment for the present invention should be solid-state wax for which weight-average molecular weight (Mw), according to GPC of general expression R–Y, is 3000 or smaller (in the expression, R denotes the hydrocarbon radical and Y denotes the hydroxyl group, the carboxyl group, the alkyl ether group, the ester group and the sulfonyl group). A specific example compound can be (A) $CH_3(CH_2)_nCH_2OH$ (where the average value of n is 20 to 300)

(B) $CH_3(CH_2)_nCH_2COOH$ (where the average value of n is 20 to 300)

(C) $CH_3(CH_2)_nCH_2OCH_2(CH_2)_mCH_3$ (where the average value of n is 20 to 300 and the average value of m is 0 to 100)

Compounds (B) and (C) are derivatives of compound (A), and the main chain is a straight chain of saturated hydrocarbon. Other than those above, a derivative compound of compound (A) can be employed. An especially desirable wax is one that contains as a main component macromolecular alcohol, represented by $CH_3(CH_2)_nOH$ (where the average of n is 20 to 300).

It is desirable that an inorganic fine powder be added to the magnetic toner of the present invention to provide electrification stability and to improve development, flowability and durability.

The inorganic fine powder used for the present invention can be silica fine powder, titanium oxide or alumina. In particular, a powder, a specific surface area of which is brought in a range of 30 $m^2/g$ or greater by nitrogen adsorption that is measured by the BET method, provides satisfactory effects. The inorganic fine powder should be 0.01 to 8 parts by weight, preferably 0.1 to 5 parts by weight, relative to the magnetic toner particles of 100 parts by weight.

Preferably, to obtain hydrophobicity and charge control, the inorganic fine powder used for the present invention is processed, as needed, using silicone varnish, modified silicone varnish, silicone oil, modified silicon oil, a silane coupler, a silane coupler having a functional group, or another organic silicon compound. These agents may be used together.

Another preferred additive is a lubricating agent, such as Teflon powder, zinc stearate powder, poly(vinylidene fluoride) powder or silicone oil powder (containing about 40% silica). Abrasives, such as cerium oxide powder, silicon carbide powder and strontium titanate powder, can be also employed. A small amount of electroconductive agent, such as carbon black, zinc oxide, antimony oxide or tin oxide, and a small amount of fine white particles and fine black particles having a polarity opposite to that of the magnetic toner can also be employed as a development enhancement materials.

A well known method is employed to produce the magnetic toner of the present invention. For example, a binder resin, a magnetic substance, wax, a metal salt or a metal complex, a pigment or a dye as a coloring agent and, as needed, a charge control material and other additives are mixed well by a mixer, such as a Henschel mixer or a ball mill. The material is melted and kneaded by a thermal kneading machine, such as a heat roll, a kneader or an extruder. Then, the metal compound, the pigment, the dye and the magnetic substance are dispersed or dissolved in a melting resin. After the material is cooled and solidified, it is pulverized and classified to obtain the magnetic toner of the present invention. For the classification procedure, preferably, a multi-divisional air stream classifier is used for efficiency of production.

An explanation will now be given for a preferred example multi-divisional air stream classifier that can be used for the production of the magnetic toner of the present invention that has a specific particle distribution.

Figure 8:
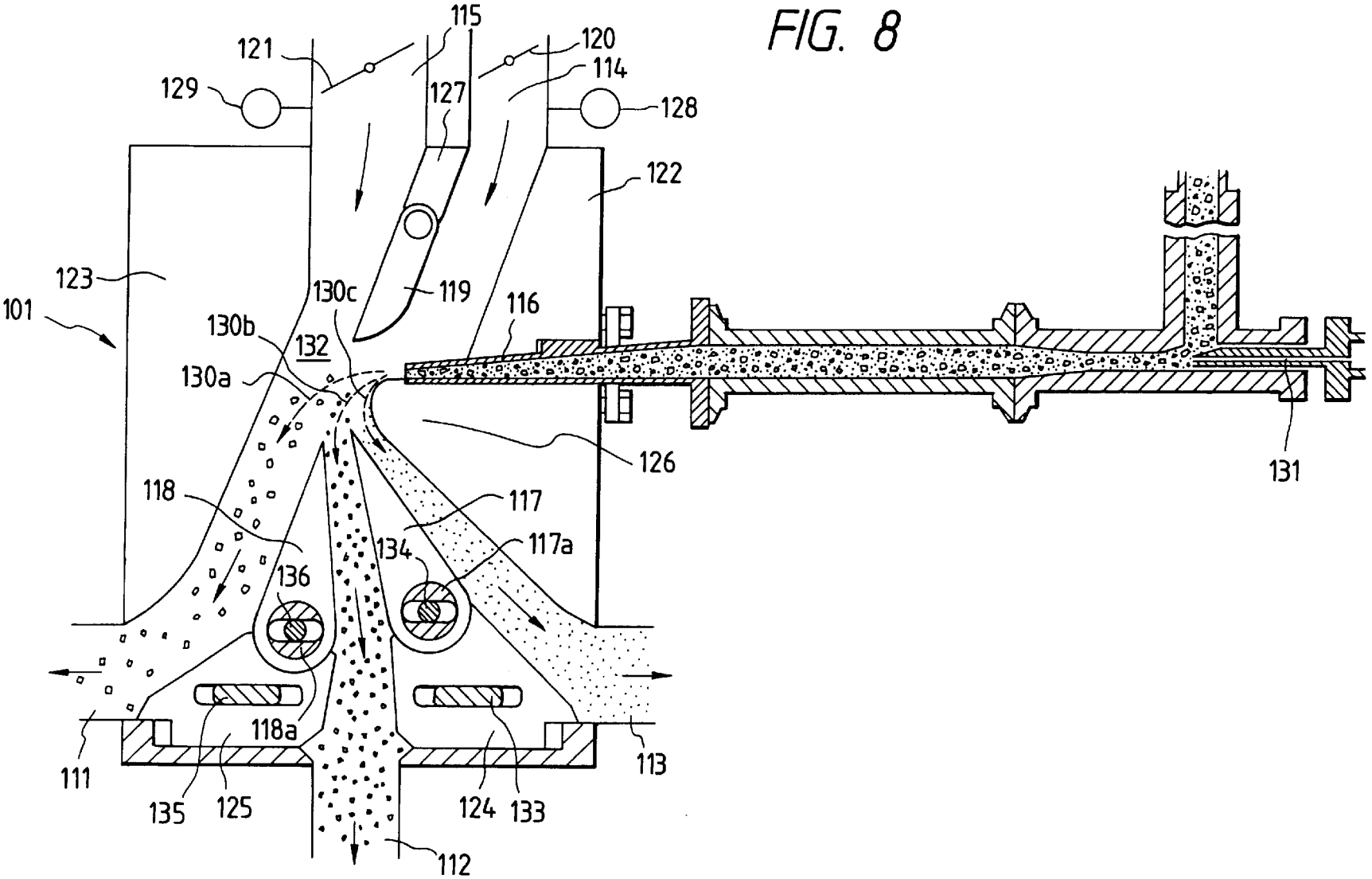
FIG. 8 is a schematic diagram for explaining a multi-divisional air stream classifier used for adjusting the magnetic toner of the present invention that has a specific particle distribution.

An apparatus in FIGS. 8 (cross-sectional view), 9 and 10 (perspective views) is a specific example of the multi-divisional air stream classifier.

Figure 9:
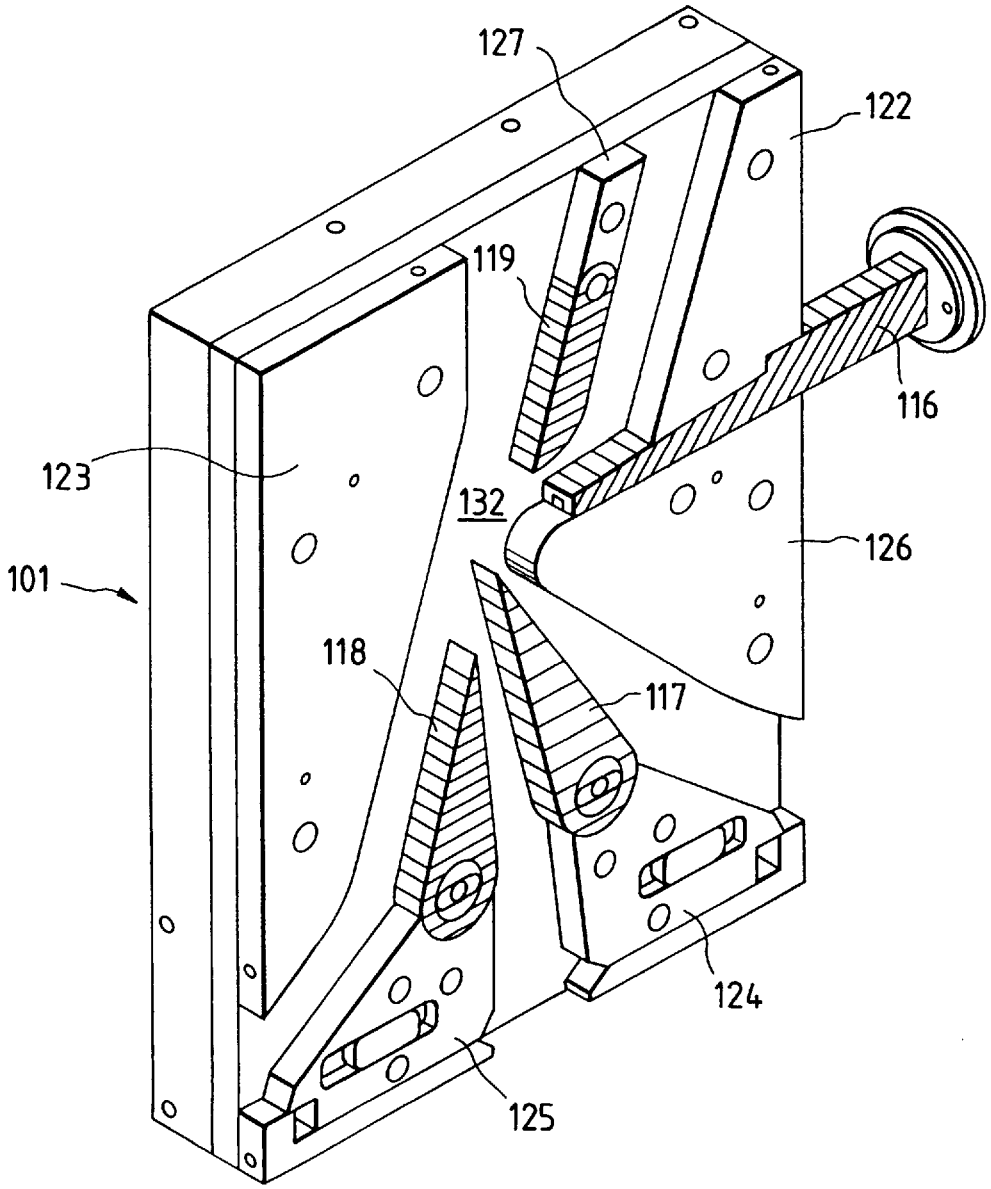
FIG. 9 is a partial perspective view of the air stream classifier shown in FIG. 8.
Figure 10:
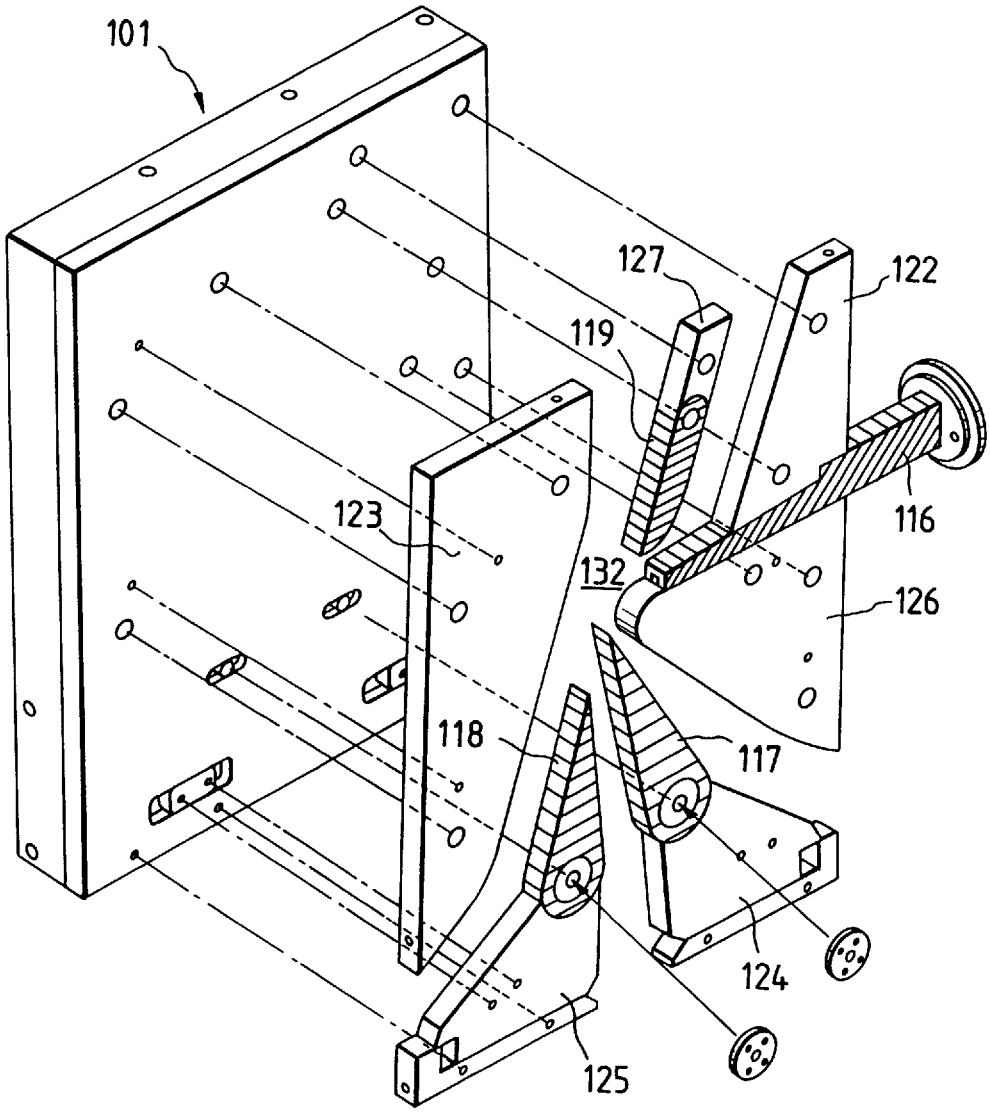
FIG. 10 is an explanatory diagram showing the air stream classifier in FIG. 8.

In FIGS. 8, 9 and 10, side walls 122 and 123 form part of a classification chamber, and a classification edge block 124 includes a first classification edge 117, while a classification edge block 125 has a second classification edge 118. The classification edges 117 and 118 are respectively rotatable at a first shaft 117*a* and a second shaft 118*a*. In consonance with the rotation of the classification edges 117 and 118, the positions of the classification edge distal ends can be changed. The installation positions of the classification edge blocks 124 and 125 can be slid to the right or to the left, and accordingly, their classification edges 117 and 118, which are shaped like knife blades, can also slide in the same direction or in almost the same direction.

The classification zone of the classification chamber 132 is divided into three regions by the classification edges 117 and 118: a first classification region that is defined between a Coanda block 126 and the first classification edge 117 to separate small particles having a diameter smaller than a predetermined diameter; a second classification region that is defined between the first classification edge 117 and the second classification edge 118 to separate middle sized particles having a predetermined diameter; and a third classification region to separate coarse grains having a diameter that is larger than the predetermined diameter.

A material supply nozzle 116, with its opening toward the classification chamber 132, is provided under the side wall 122, and below it a Coanda block 126 is located which is shaped as a prolate elliptic arc in the direction in which is extended the tangent of the bottom of the material supply nozzle 116. An intake edge 119, which is shaped like a knife blade and is located toward the lower portion of the classification chamber 132, is attached to an upper block 127 in the classification chamber 132. In addition, intake tubes 114 and 115, which open toward the classification chamber 132, are located in the upper position of the classification chamber 132. First gas introduction adjustment means 120 and second gas introduction adjustment means 121, which serve as dampers, and static pressure gauges 128 and 129 are provided for the intake tubes 114 and 115.

The positions of the classification edges 117 and 118 and the intake edge 119 are adjusted in consonance with the type of magnetic toner particles and a desired particle diameter.

Discharge ports 111, 112 and 113, which open toward the classification chamber 132, are provided at the bottom of the classification chamber 132 for the respective classification regions. Pipes that serve as communication means are connected to the discharge ports 111, 112 and 113, and opening and closing means, such as valves, may be provided for the communication means. The material supply nozzle 116 is constituted by a square cylinder and a pyramidal cylinder. When the ratio of the internal diameters at the narrowest portions of the square cylinder and the pyramidal cylinder is set to from 20:1 to 1:1, preferably from 10:1 to 2:1, a satisfactory introduction velocity is acquired. A supply port through which magnetic toner particles are supplied to the material supply nozzle 116, and an injection air introduction tube 131 through which air is supplied to feed the magnetic toner particles are provided at the rear end of the material supply nozzle 116.

With the above structure, the classification operation in the multi-divisional classification regions is performed as follows. The pressure in the classification chamber 132 is reduced through at least one of the discharge ports 111, 112 and 113. The magnetic toner particles are injected, at a preferable velocity of 50 to 300 m/sec, into the classification chamber 132 through the material supply nozzle 116, which has an opening directed toward the classification chamber 132, by using a high-pressure air stream and a reduced pressure air stream that flow from the injection air introduction air tube 131 through the material supply nozzle 116.

The magnetic toner particles introduced into the classification chamber 132 are moved along curved paths 130*a*, 130*b* and 130*c* by the Coanda effect of the Coanda block 126 and a gas, such as air, that flows in at this time. In consonance with the diameter of the toner particles and the magnitude of the inertia of the particles, large toner particles (coarse grains) are sorted to the first region outside the air stream (i.e., the outside of the classification edge 118), the middle sized toner gains are sorted to the second region between the classification edges 118 and 117, and small toner particles are sorted to the third region inside the classification edge 117. The separated, large toner particles are discharged from the discharge port 111, the middle sized toner particles are discharged from the discharge port 112, and the small toner particles are discharged from the discharge port 113.

For the classification of the magnetic toner particles, classification points are mainly determined by the positions of the distal ends of the classification edges 117 and 118 relative to the left end of the Coanda block 126, from which the magnetic toner particles are injected into the classification chamber 132. The classification points are affected by the air flow rate of a classification air stream or by the velocity imparted to the magnetic toner particles when they are expelled from the material supply nozzle 116.

In the multi-divisional air stream classifier, when the magnetic toner particles are introduced into the classification chamber 132, they are dispersed in consonance with their sizes and particle streams are formed, so that the classification edges 117 and 118 can be moved along the stream lines to positions at which their distal ends can be fixed and predetermined classification points (particle distribution points) can be set. When the classification edges 117 and 118 are moved together with the classification edge blocks 124 and 125, the edges can be directed along the toner particle streams that are flying along the Coanda block 126.

A specific example of an image forming method using the magnetic toner of the present invention will now be described while referring to FIG. 1.

Figure 1:
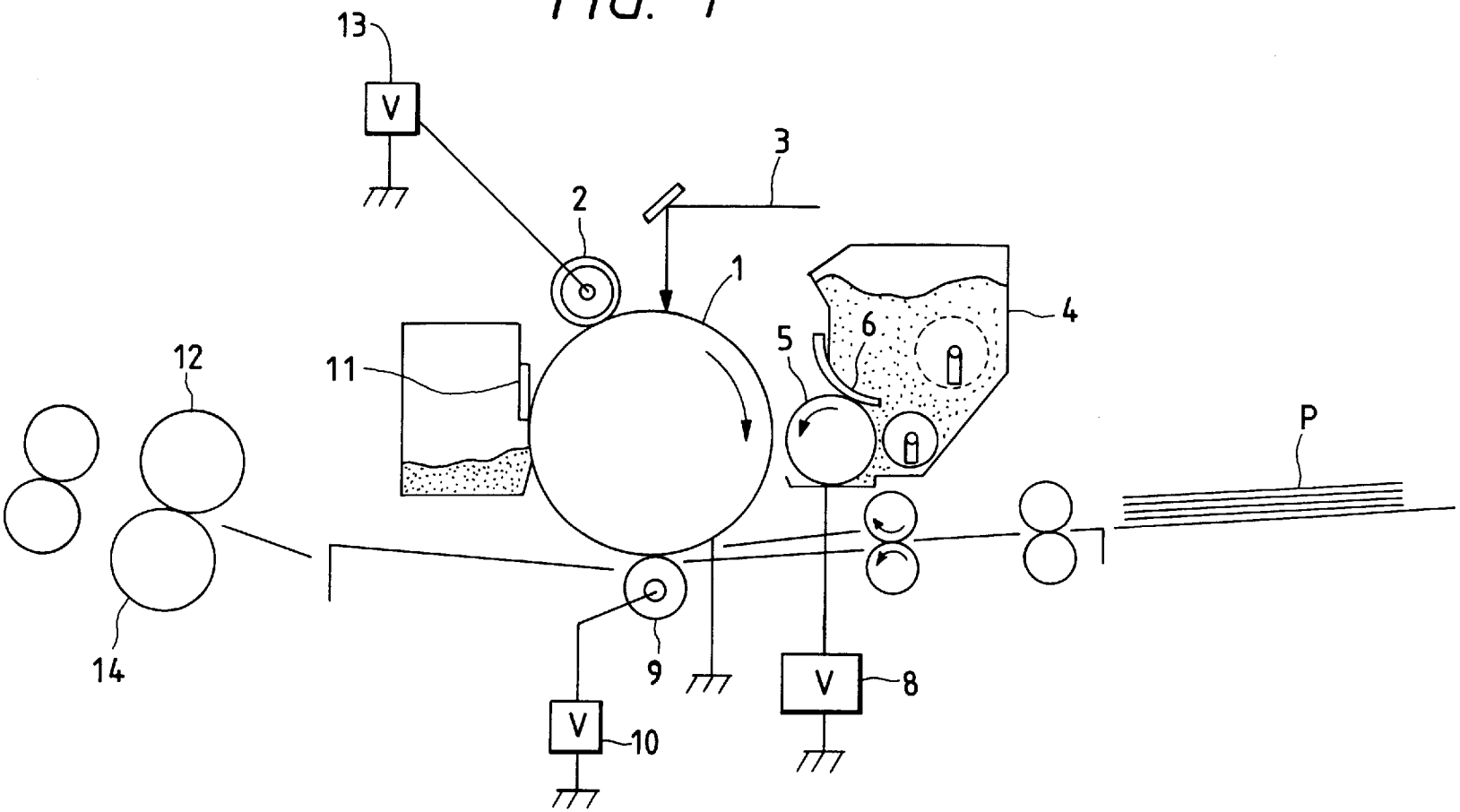
FIG. 1 is a schematic diagram for explaining a specific example of an image forming apparatus that performs an image forming method according to the present invention.

In FIG. 1, a primary charging unit (e.g., a charge roller) 2, an exposure optical system 3, a developing unit 4 having a development sleeve 5, a transfer unit (a transfer roller) 9, and a cleaning unit (which has a cleaning blade) 11 are provided around the periphery of an electrostatic latent image bearing member 1, which is shaped like a rotary drum.

In an image forming apparatus in FIG. 1, the surface of the electrostatic latent image bearing member 1, which is a photosensitive member, is uniformly electrified by the primary charging unit 2, to which a bias voltage is applied by bias voltage application means 13. Image exposure is performed by the exposure optical system 3 to form an electrostatic latent image on the electrostatic latent image bearing member 1.

Following this, a magnetic toner image is formed by a toner layer thickness restricting member 6 on the surface of the rotating development sleeve 5, which includes a fixed magnet. A bias voltage, a pulse bias voltage and/or a direct current bias voltage are alternately applied to the development sleeve 5 by the bias voltage application means 8, while the electrostatic latent image formed on the electrostatic latent image bearing member 1 is developed by the developing unit 4.

Transfer paper sheet P is fed as a transfer member, and electric charges having a polarity opposite to that of the magnetic toner are applied to the reverse face of the transfer paper sheet P by the transfer unit 9, to which a bias voltage is applied by the voltage-applying means 10, thereby effecting the transfer of the toner image to the transfer paper sheet P.

The transfer paper sheet P on which is held the toner image is passed through a heat/pressure fixing unit, which has a heat roller 12 and a pressing roller 14, to generate a copy or printed material.

The toner that remains on the electrostatic latent image bearing member after the transfer procedure is completed is removed by the cleaning blade 11 of the cleaning unit. Then, the process that follows the primary charging is repeated.

The primary charging unit 21 can be a charging brush and a charging blade in addition to a charging roller.

The transfer unit 9 can be a transfer belt in addition to the transfer roller shown in FIG. 1.

Figure 2:
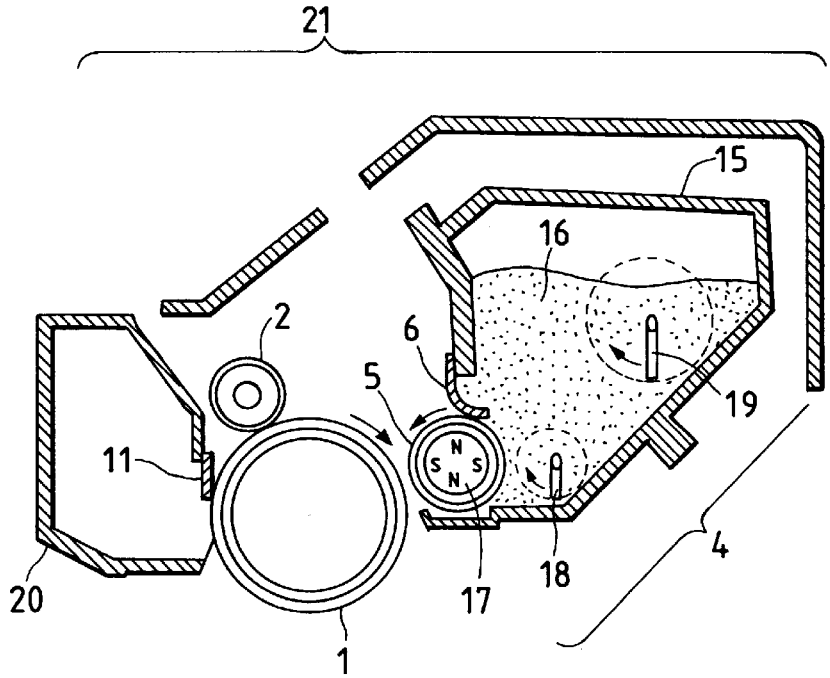
FIG. 2 is a schematic diagram for explaining an apparatus unit (process cartridge) having a development apparatus.

FIG. 2 is shown an example apparatus unit (e.g., a processing cartridge) that can be detached from the main body of the image forming apparatus.

An apparatus unit 21 comprises: a container 15, in which frictional electrification magnetic toner 16 is retained; a development sleeve 5, for feeding the magnetic toner 16 to a development area that faces a photosensitive drum 1; a development unit 4, which has an elastic blade 6 that is a toner layer thickness restriction member for frictional electrification of the magnetic toner 16; a charging roller 2, which is contact charging means for electrifying the photosensitive drum 1; and cleaning means 20, which has a cleaning blade 11 for cleaning the surface of the photosensitive drum 1.

A fixed magnet 17 is provided inside the development sleeve 5. The fixed magnet 17 has a first magnetic pole facing a first magnetic toner agitating member 18, a second magnetic pole facing the toner layer thickness restriction member 6; and a third magnetic pole that is a development magnetic pole. In addition, a fourth magnetic pole is also provided for the fixed magnet 17 in FIG. 2 that forms a magnetic seal and prevents the leakage of the magnetic toner from the lower portion of the container 15. A second magnetic toner agitating member 19 is provided at the upper portion of the container 15 to feed the magnetic toner 16 to a first magnetic toner agitating member 18.

Figure 3:
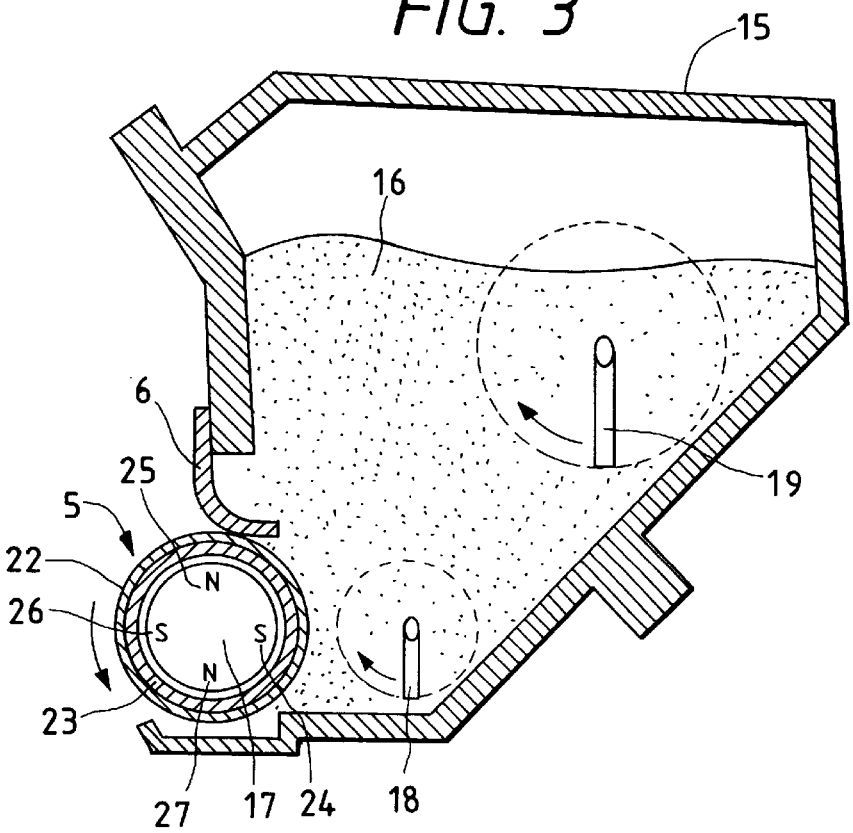
FIG. 3 is an enlarged diagram showing the development apparatus in the apparatus unit in FIG. 2.

FIG. 3 is an enlarged diagram showing the development unit 4 provided in the apparatus unit 21 in FIG. 2. In FIG. 3, a resin coated layer 22 in which conductive powder is dispersed is formed on a base 23 (e.g., a cylindrical aluminum tube or a cylindrical SUS tube) of the development sleeve 5. For the feeding of magnetic toner and for the formation of a uniform magnetic toner layer, it is desirable that the surface of the development sleeve 5 have an average center line roughness (Ra) of 0.3 to 2.5 $\mu$m (more desirably, 0.6 to 1.5 $\mu$m). Although the development sleeve 5 may be the base 23 itself, it is better to form the resin coated layer 22 because contamination of the surface of the development sleeve 5 by the magnetic toner is restricted and the durability for printing multiple copies is improved.

The resin coated layer 22 that is employed contains conductive powder in a film formation polymer. It is preferable that the conductive powder have a resistance of 0.5 $\Omega$·cm or less after it is pressurized at 120 Kg/cm$^2$.

A preferable conductive powder is fine carbon particles, a mixture of fine carbon particles and crystalline graphite, or crystalline graphite. The preferable conductive powder has a diameter of 0.005 to 10 $\mu$m.

The crystalline graphite is roughly sorted into natural graphite and artificial graphite. For production of the artificial graphite, pitch coke is coagulated by a coupling material, such as a tar pitch, and the coagulated material is annealed at approximately 1200° C. and is processed at about 2300° C. in a graphitizing furnace, so that the carbon crystal grows and changes to graphite. Natural graphite is a material obtained from the earth that over a long period of time has been completely graphitized by the application of natural ground heat and high pressure underground. Either natural or artificial graphite has wide industrial applications because of its various excellent properties. Graphite is a shiny black, very soft and smooth crystalline mineral that has a smooth texture, heat resistance and chemical stability. The crystal structure is a hexagonal system or rhombohedral system and has a layered structure. As for its electrical characteristics, free electrons exist between bound carbon atoms, and it possesses a preferable electrical conductivity. Either natural graphite or artificial graphite can be employed.

It is preferable that the diameter of graphite be 0.5 to 10 $\mu$m.

The film formation polymer is, for example, thermoplastic resin, such as styrene resin, vinyl resin, polyether sulfone resin, polycarbonate resin, polyphenylene oxide resin, polyamide resin, fluoro resin, cellulose resin or acrylic resin; a thermosetting resin, such as epoxy resin, polyester resin, alkyd resin, phenol resin, melamine resin, polyurethane resin, urea resin, silicone resin or polyimide resin; or a photosetting resin. In particular, a mold release resin, such as silicone resin or fluoro resin, or a resin having a superior mechanical property, such as polyether sulfone, polycarbonate, polyphenylene oxide, polyamide, phenol resin, polyester, polyurethane or styrene series resin, are more desirable. Phenol resin is especially suitable.

Amorphous carbon, such as conductive carbon black, is generally defined as having a "crystal texture that is produced by burning or thermally decomposing a compound containing hydrocarbon or carbon under conditions where there is an insufficient supply of air." Amorphous carbon is especially superior in electric conductivity, so that conductivity can be provided for a polymer by packing amorphous carbon in it, or an arbitrary conductivity can be acquired by controlling the amount that is to be added.

The particle diameter of conductive amorphous carbon is 5 to 100 mμ, desirably, 10 to 80 mμ, and more desirably, 15 to 40 mμ.

It is preferable that a conductive powder of 15 to 60% by weight be dispersed in the resin coated layer 22.

When a mixture of fine carbon particles and graphite particles is employed, preferably, fine carbon particles are 1 to 50 parts by weight relative to a 10 parts by weight for graphite.

The volume resistance rate for the resin coated layer, of the development sleeve, in which the conductive powder is dispersed is $10^{-6}$ to $10^{6}$ Ω·cm.

A magnetic blade may be provided opposite the second magnetic pole 25 to serve as the toner layer thickness restriction member 6. However, it is more desirable, for the apparatus unit and for the image forming method of the present invention, that the elastic blade be so provided opposite the second magnetic pole 25 that it forms a nip portion because a frictional electrification amount in an appropriate range can be provided for the magnetic toner, and a magnetic toner layer having a uniform thickness can be formed. The elastic blade may be formed of a rubber, such as silicone rubber or urethane rubber, or may be formed of a metal, such as nonmagnetic stainless steel.

It is preferable that the elastic blade 6 be so located that its drawing pressure be 5 to 50 (gf) (more desirably, 15 to 40 (gf)) relative to the development sleeve 5, so that frictional electrification can be appropriately performed for the magnetic toner, a uniform toner image can be formed, and contamination with toner of the surface of the development sleeve 5 can be prevented.

Desirably, the first magnetic pole 24 of the fixed magnet 17 in the development sleeve 5 is 520 to 870 gauss (more desirably, 600 to 800 gauss), so that the magnetic toner that is fed as the first magnetic toner agitating member 18 rotates can be smoothly applied to the surface of the development sleeve 5. In addition, desirably, the second magnetic pole 25 is 600 to 950 gauss (more desirably, 650 to 850 gauss), so that a uniform toner layer can be formed with the elastic blade 6.

The third magnetic pole of the fixed magnet 17 is desirably 700 to 1000 gauss (more desirably, 750 to 950 gauss) so that a development magnetic pole is formed in the development area that can suppress the occurrence of fogging.

A method according to the present invention for measuring various properties of various materials will now be described.

Method for measuring sphericity (ψ):

(1) The minimum length (μm) and the maximum length (μm) of a particle of a magnetic substance are measured as follows.

A particle sample of the magnetic substance is processed by using a collodion film copper mesh and an electron microscope (Hitachi, Ltd. H-700H). This sample is photographed at a magnification of 10,000 at a voltage of 100 kV. The development magnification rate is three times as high and the final magnification rate is 30,000. From a photograph, 100 particles are selected at random to measure the minimum and the maximum lengths of the particles of the magnetic substance.

(2) The sphericity (ψ) of the magnetic substance is calculated as follows.

$$\text{Sphericity } (\psi) = \frac{\text{minimum length } (\mu m) \text{ of magnetic substance particle}}{\text{maximum length } (\mu m) \text{ of magnetic substance particle}}$$

The sphericity for 100 magnetic substance particles measured in the above described manner is calculated, and the average sphericity is determined to be the sphericity (ψ) for the magnetic substance. Method for measuring the silicon compound contained in magnetic substance:

The magnetic substance and deionized water are placed in a beaker and are maintained at a temperature of about 50° C. An adequate amount of special grade hydrochloric acid is added to the fluid, which is then agitated until the magnetic substance is completely dissolved. A solution in which the magnetic substance is dissolved is filtered using a 0.1 μm membrane filter. Inductively coupled plasmatic emission spectroscopy (ICP) of the filtered fluid is performed to obtain a quantitative analysis for iron elements and silicon elements.

Method for measuring amount (W) of silicon dioxide that exists on surface of magnetic substance particle:

(1) Silicon dioxide ($SiO_2$) that exists in the surface of the magnetic substance is eluted using 2N—NaOH solution (40° C., 30 minutes).

(2) The amounts of $SiO_2$ in the magnetic substance before and after elution are measured by X-ray fluorescence analysis. Thus, W (%)=(the amount of $SiO_2$ before elution—the amount of $SiO_2$ after elution)/weight of magnetic substance before elution. Method for measuring volume specific resistance of magnetic substance:

A 10 g quantity of the magnetic substance is placed in a measurement cell and is granulated using a hydraulic cylinder (at a pressure of 600 kg/cm$^2$). When the pressure is released, a resistance meter (YEW MODE L2506A DIGITAL MULTIMETER produced by Yokokawa Electric Corporation) is set, and a pressure of 150 kg/cm$^2$ is again exerted by the hydraulic cylinder. A voltage of 100 V is applied, and the measurement is begun by the reading of measured values after three minutes have elapsed. The thickness of the sample is measured and a volume specific resistance is acquired using the following expression.

$$\text{Volume specific resistance } (\Omega \cdot \text{cm}) = \frac{\text{resistance } (\Omega) \times \text{sample cross-sectional area } (\text{cm}^2)}{\text{sample thickness (cm)}}$$

Method for measuring volume frictional electrification amount relative to iron powder in magnetic toner:

The measurement is conducted in a normal-temperature/normal-humidity environment.

Figure 6:
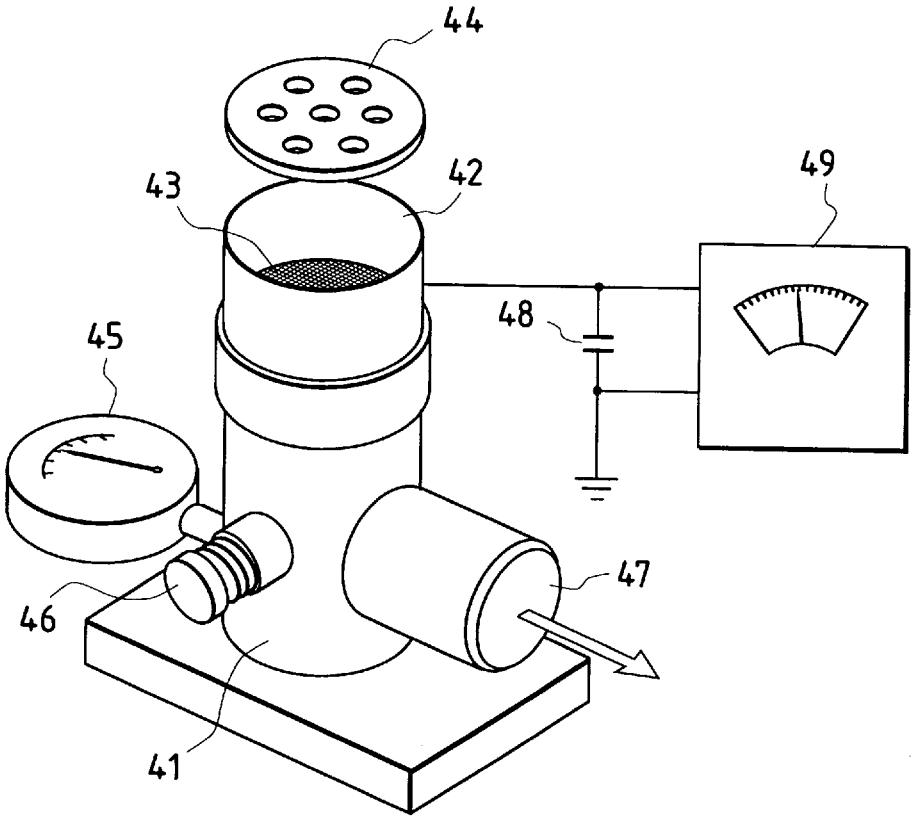
FIG. 6 is a schematic diagram for explaining a measurement device for measuring the amount of frictionally electrified magnetic toner relative to iron powder.

A 1 g quantity of magnetic toner and a 9 g quantity of iron powder of 250 mesh-pass and 350 mesh-on are mixed together and are shaken for 150 seconds to acquire a measurement sample. After the sample has been weighed, it is placed in a metal measurement container 42, shown in FIG. 6, in which at the bottom is provided a 500 mesh conductive screen 43 (changeable as needed to a size that magnetic particles can not pass through), and the container 42 is closed with a metal cover 44. The gross weight of the container 42 is $W_1$ (g). Then, an aspirating device 41 (at the least, an insulator is provided for a portion that contacts the container 42) adjusts an air flow rate adjustment valve 46 by aspiration, using an aspiration port 47, to set the pressure for a vacuum gauge 45 to 250 mmAq. In this condition, aspiration is appropriately performed (for about two minutes) to remove the magnetic toner. Assuming that at this time the voltage at an electrometer 49 is V (volt), the capacity of a capacitor 48 is C ($\mu$F) and the weight of the container 42 after aspiration is $W_2$(g), a frictional electrification amount T (mC/kg) for the magnetic toner is calculated as follows:

$$T(mC/kg)=(C\times V)/(W_1-W_2)$$

Method for measuring void ratio of magnetic toner: (1) Method for measuring the true density of magnetic toner:

Prepared are a stainless steel cylinder, having an internal diameter of 10 mm and a length of about 5 cm; a disk (A), having an external diameter of about 10 mm and a height of 5 mm that can be inserted into and closely attached to the container; and a piston (B), having an external diameter of about 10 mm and a length of about 8 cm. First the disk (A) is positioned at the bottom of the cylinder, and following this, the measurement sample of approximately 1 g is placed in the cylinder and the piston (B) is slowly pushed therein. Then, a hydraulic press is used to compress the sample at a driving force of 400 Kg/cm$^2$ for five minutes. Thereafter, the compressed sample is extracted and weighed (wg), and its the diameter (Dcm) and height (L cm) are measured. The true density is then calculated using the following expression.

$$\text{True density (g/cm}^3) = \frac{W}{\pi \times (D/2)^2 \times L}$$

(2) Method for measuring tap density of magnetic toner:

The tap density of the magnetic toner (g/cm$^3$) is a value that is measured by using a powder tester produced by Hosokawa Micron Co., Ltd., and a container associated with the powder tester, while following the instructions given for the procedures included in the operation manuals for the powder tester.

(3) The void ratio of magnetic toner is calculated using the following expression:

$$\text{Void rate} = \frac{\text{(true density)} - \text{(tap density)}}{\text{(true density)}}$$

Figure 7:
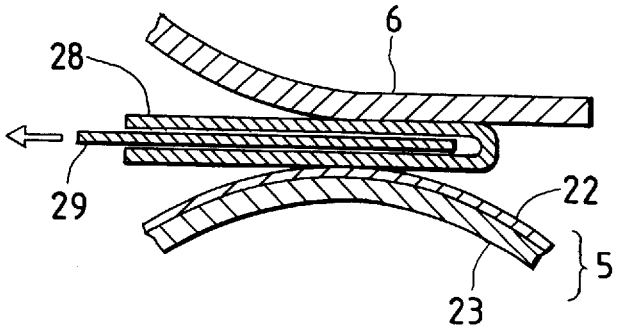
FIG. 7 is a diagram for explaining a measurement method for drawing pressure.

Method for measuring drawing pressure between elastic blade and development sleeve:

As is shown in FIG. 7, a SUS thin film 28 (having thickness of 50 $\mu$m, a length of 50 mm and a width of 10 mm) is sandwiched at the nip portion that is formed by the elastic blade 6 and the development sleeve 5, and the force exerted when one SUS thin film 29 (having a thickness of 50 $\mu$m, a length of 50 mm and a width of 10 mm) is held in the film 28 is measured. In this manner, the drawing pressure (gf) can be measured. Method for measuring average center line roughness ($R_a$) of surface of development sleeve:

The degree of roughness of the surface of the development sleeve is measured according to a method for measuring average center line roughness ($R_a$) described in JIS B0601, 1982. While the cutoff value is set to 0.8 mm and the measurement length l is 2.5 mm, average center line roughness ($R_a$) is measured. The measurement is conducted at four positions for one development sleeve, and the average value is determined to be the average center line roughness ($R_a$).

When the portion that includes the measured length l is extracted from a roughness curve in the direction of the center line and the center line of the extracted portion is defined as the X axis, the direction of depth magnification is defined as the Y axis and the roughness curve is expressed as y=f(x). The average center line roughness, acquired by using the following expression, is a value is represented as micrometers ($\mu$m):

$$R_a = \frac{1}{l}\int_0^l |f(x)|dx$$

Figure 5:
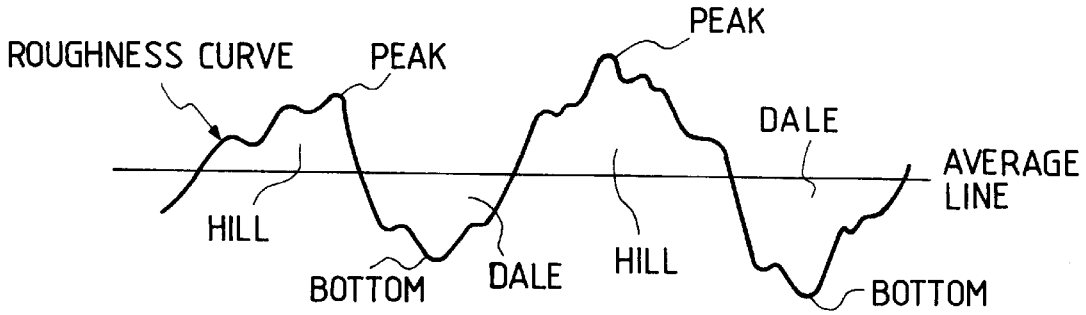
FIG. 5 is an explanatory diagram for average center line roughness ($R_a$ )

An average line for a roughness curve is a linear line, or a curved line, that has the geometric shape of a measured face at an extracted portion of a roughness curve, and that is so set that the sum of the squares of the deviations obtained from that line to a cross-sectional curve, or to a roughness curve, is the minimum. See FIG. 5. The center line for a roughness curve is a linear line such that the areas enclosed by the roughness curve on either side of the linear line, which is drawn parallel to the average line for the roughness curve, are equal.

A measurement apparatus is, for example, "Surfcorder SE-3400" produced by Kosaka Kenkyujo Co., Ltd.

The present invention will be specifically described by referring to manufacturing examples and examples.

Magnetic substance manufacturing example 1

Silicic soda was added to an iron(II) sulfate aqueous solution so that the silicon element content relative to iron elements was 2.9% by weight. A solution of sodium hydroxide having a chemical equivalent of 1.1 to 1.2 relative to iron ions was mixed to adjust the aqueous solution containing iron(II) hydroxide.

While the pH of the aqueous solution was maintained at 7.0 to 9.0, 35 liters/min of air was blown into the solution to keep the temperature of the solution at 82° C., and an oxidation reaction occurred that produced magnetic particles. Using the normal method, the magnetic particles that were produced were rinsed, filtered and dried, and coagulated substances were pulverized. As a result, magnetic substance No. 1, which had the properties shown in Table 1, was obtained. Magnetic substance manufacturing examples 2 to 6 and comparative magnetic substance manufacturing examples 1 and 2

Magnetic substances Nos. 2 to 6 and comparative magnetic substances Nos. 1 and 2 shown in Table 1 were generated under different manufacturing conditions.

EXAMPLE 1

| | |
|---|---|
| Binder resin (styrene resin) | 100 parts by weight |
| Magnetic substance No. 1 (number-average particle diameter = 0.20 $\mu$m spherical shape (sphericity of 0.99) $\sigma_r \times H_c$ = 26 (kA$^2$m/kg) W × R = 0.039) | 100 parts by weight |
| Negative charge control agent (monoazo Fe complex) | 2 parts by weight |
| Wax (aliphatic alcohol wax) | 5 parts by weight |

The above materials were mixed and dispersed by a Henschel mixer, and were melted and kneaded by a two-axle extruder. The kneaded substance was cooled and roughly ground, and the resultant substance was further pulverized by a pulverizer that used a jet stream. Then, an air stream classifier and a multi-divisional classifier that utilized the Coanda effect were employed to obtain magnetic toner. Silica having a 1.5 parts by weight, for which a hydrophobic process was performed using silicone oil, was added to the magnetic toner having a 100 parts by weight, and the two were mixed together by the Henschel mixer. As a result, magnetic toner No. 1, having a weight-average particle diameter of X=5.7 $\mu$m and Y=16.5% by number and Z=3.8% by number, was obtained. The void ratio acquired by using the tap density of magnetic toner No. 1 was 0.57. The properties of magnetic toner No. 1 are shown in Table 2. The thus obtained magnetic toner No. 1 was fed to a development unit for a process cartridge, which was acquired by improving the processing cartridge for a Canon LBP printer 720. The improved processing cartridge was attached to the LBP printer, and an evaluation was made by using the following image evaluation method. The results are shown in Table 3.

For the improved processing cartridge, a phenol resin layer (having a thickness of about 10 $\mu$m), in which carbon black of 3.1% by weight and graphite of 29.5% by weight were dispersed, was coated on the surface of a development sleeve (diameter of 16 mm) that had an aluminum tube as a base. A fixed magnet (with a diameter of 13 mm and a first magnetic pole of 730 gauss, a second magnetic pole of 800 gauss, a third magnetic pole of 900 gauss and a fourth magnetic pole of 750 gauss) was internally provided in the development sleeve.

The average center line roughness ($R_a$) of the surface of the development sleeve was 1.2 $\mu$m. A silicone resin elastic blade, which had a thickness of 1.5 mm, that pushed against the development sleeve was located in the direction of a counter, so that the drawing pressure was 25 (gf).

In the LBP printer to which the improved process cartridge was attached, an OPC photosensitive drum (with a diameter of 30 mm) that had a polycarbonate resin layer was rotated at a peripheral velocity of 94 mm/sec, the development sleeve was rotated at a peripheral speed of 112 mm/sec, and a direct current bias voltage of −450 V and an alternating current bias voltage $V_{pp}$ of 1600 V (2200 $H_z$) were applied to the development sleeve. After the OPC photosensitive drum was electrified to −600 V by a charging roller that contacted it, the OPC photosensitive drum was irradiated by a laser beam and a digital latent image was formed. Then, the digital latent image was invertedly developed by the development unit of the improved processing cartridge, so that a magnetic toner image was formed on the OPC photosensitive drum. The magnetic toner image on the OPC photosensitive drum was transferred to a regular sheet of paper by a transfer roller (the transfer bias was 1500 V, and a linear pressure of 30 g/cm was applied to the OPC photosensitive drum). The magnetic toner image on the sheet was then fixed by a heat/pressure fixing unit. After the transfer, the surface of the OPC photosensitive drum was cleaned by a cleaning blade. Thereafter, the charging procedure using the charging roller, the development procedure, the transfer procedure and the cleaning procedure was repeated.

(A) Image evaluation in a low-temperature/low-humidity (L/L) environment

The density of a black solid image obtained after 1000 sheets were printed was measured by a Macbeth densitometer. To measure fogging, the degree of whiteness of a transfer sheet before printing was measured in advance by a "reflector meter" (produced by Tokyo Denshoku Co., Ltd.), and a value, at which a difference from the degree of whiteness of a preconditioned white image after printing was the maximum, was indicated (obtained for a 3000 printed sheet run).

(B) Drum fusion in a high-temperature/high-humidity (H/H) environment

An evaluation was made of the degree to which white spots occurred in a solid black image after 3000 sheets were printed.

Rank 5: No occurrence of white spots

Rank 3: No problem for practical use, even though several spots occurred.

Rank 1: Many (several tens of) spots occurred, and is not suitable for practical use.

Rank 4 places midway between ranks 5 and 3, and rank 2 places midway between ranks 3 and 1.

(C) Definition of character image

A sample for checking selected after 1000 sheets were printed was employed, and the size of a character "電" about 2 mm square was enlarged 30 times. The evaluation was conducted according to the following evaluation standards.

A: Character lines well defined.

B: Image quality midway between A and C.

C: Several black spots observed near character lines.

D: Black spots noticeable.

EXAMPLE 2

Magnetic toner No. 2 was produced in the same manner as was the toner for Example 1, except for using the magnetic substance No. 2 that had a number-average particle diameter of 0.18 $\mu$m and a spherical shape (sphericity of 0.99) and that had $\sigma_r \times H_c$=38 ($kA^2m/kg$) and W×R=0.039. The thus obtained magnetic toner No. 2 was evaluated in the same manner as was the toner for Example 1. The void ratio was 0.57, and the properties of the magnetic toner No. 2 are as shown in Table 2. The results of the evaluation are shown in Table 3.

EXAMPLE 3

Magnetic toner No. 3 was produced in the same manner as in Example 1, except for employing the magnetic substance No. 3 that had a number-average particle diameter of 0.18 $\mu$m and a spherical shape (sphericity of 0.99) and that had $\sigma_r \times H_c$=38 ($kA^2m/kg$) and W×R=0.024. The thus obtained magnetic toner No. 3 was evaluated in the same manner as was the toner for Example 1. The void ratio was 0.57, and the properties of the magnetic toner No. 3 are as shown in Table 2. The results of the evaluation are shown in Table 3.

EXAMPLE 4

Magnetic toner No. 4 was produced in the same manner as in Example 1, except for employing the magnetic substance No. 4 that had a number-average particle diameter of 0.15 $\mu$m and a spherical shape (sphericity of 0.99) and that had $\sigma_r \times H_c$=52 ($kA^2m/kg$) and W×R=0.012. The thus obtained magnetic toner No. 4 was evaluated in the same manner as was the toner for Example 1. The void ratio was 0.57, and the properties of the magnetic toner No. 4 are as shown in Table 2. The results of the evaluation are shown in Table 3.

EXAMPLE 5

Magnetic toner No. 5 was produced in the same manner as in Example 1, except for employing the magnetic substance No. 5 that had a number-average particle diameter of 0.20 μm and a spherical shape (sphericity of 0.98) and that had $\sigma_r \times H_c$ =30 ($kA^2m/kg$) and W×R=0.039. The thus obtained magnetic toner No. 5 was evaluated in the same manner as was the toner for Example 1. The void ratio was 0.57, and the properties of the magnetic toner No. 5 are as shown in Table 2. The results of the evaluation are shown in Table 3.

EXAMPLE 6

Magnetic toner No. 6 was produced in the same manner as in Example 1, except for employing the magnetic substance No. 6 that had a number-average particle diameter of 0.22 μm and a spherical shape (sphericity of 0.97) and that had $\sigma_r \times H_c$=24 ($kA^2m/kg$) and W×R=0.045. The thus obtained magnetic toner No. 6 was evaluated in the same manner as was the toner for Example 1. The void ratio was 0.57, and the properties of the magnetic toner No. 6 are as shown in Table 2. The results of the evaluation are shown in Table 3.

EXAMPLE 7

Magnetic toner No. 7, for which X=5.36 μm, Y=9.5% and Z=3.3%, was produced in the same manner as the toner for Example 1 by using the magnetic substance No. 6 that was used in Example 6. The thus obtained magnetic toner No. 7 was evaluated in the same manner as was the toner for Example 1. The void ratio was 0.58, and the properties of the magnetic toner No. 7 are as shown in Table 2. The results of the evaluation are shown in Table 3.

EXAMPLE 8

Magnetic toner No. 8, for which X=6.4 μm, Y=5.0% and Z=1.5%, was produced in the same manner as was the toner for Example 1 by using the magnetic substance No. 6 that was used in Example 6. The thus obtained magnetic toner No. 8 was evaluated in the same manner as the toner for Example 1. The void ratio was 0.56, and the properties of the magnetic toner No. 8 are as shown in Table 2. The results of the evaluation are shown in Table 3.

Comparative Example 1

Comparative magnetic toner No. 1, for which X=7.60 μm, Y=4.8% and Z=1.2%, was produced in the same manner as was the toner for Example 1, except for employing the comparative magnetic substance No. 1 that had a number-average particle diameter of 0.25 μm and a spherical shape (sphericity of 0.94) and that had $\sigma_r \times H_c$=9 ($kA^2m/kg$)·Oe/g and W×R=0.46. The obtained comparative magnetic toner No. 1 was evaluated in the same manner as was the toner for Example 1. The void ratio was 0.40, and the properties of the comparative magnetic toner No. 1 are as shown in Table 2. The results of the evaluation are shown in Table 3.

Comparative Example 2

Comparative magnetic toner No. 2, for which X=5.70 μm, Y=16.0% and Z=4.3%, was produced in the same manner as was the toner for Example 1, except for employing the comparative magnetic substance No. 2 that had a number-average particle diameter of 0.31 μm and a spherical shape (sphericity of 0.69) and that had $\sigma_r \times H_c$=87 ($kA^2m/kg$)·Oe/g and W×R=0.001. The thus obtained comparative magnetic toner No. 2 was evaluated in the same manner as was the toner for Example 1. The void ratio was 0.50, and the properties of the comparative magnetic toner No. 2 are as shown in Table 2. The results of the evaluation are shown in Table 3.

EXAMPLES 9 through 19

The conditions for the development unit were changed as is shown in Table 4, and the tests were conducted in the same manner as was the test for Example 1. The results are shown in Table 5. Magnetic substance manufacturing example 7

Silicic soda was added to an iron(II) sulfate aqueous solution so that the content of silicon elements relative to iron elements was 1.2% by weight. A solution of sodium hydroxide having a chemical equivalent of 1.1 to 1.2 relative to iron ions is mixed to adjust the aqueous solution containing iron(II) hydroxide.

While a 7 to 9 pH was maintained for the aqueous solution, 30 liters/min of air was blown into the solution to keep the temperature of the solution at 80° C., and an oxidation reaction occurred that produced magnetic particles. Using the normal processing method, the magnetic particles were rinsed, filtered and dried, and any coagulated substance was pulverized. As a result, magnetic substance No. 7, which had the properties shown in Table 6, was obtained.

Magnetic substance manufacturing example 8

Magnetic substance No. 8, which had the properties shown in Table 6, was obtained in the same manner as was the substance in manufacturing example 7, except that silicic soda was added so that the silicon element content relative to iron elements was 3.1% by weight.

Magnetic substance manufacturing example 9

Magnetic substance No. 9, which had the properties shown in Table 6, was obtained in the same manner as was the substance in manufacturing example 7, except that silicic soda was added so that the silicon element content relative to iron elements was 3.9% by weight.

Magnetic substance manufacturing example 10

Magnetic substance No. 10, which had the properties shown in Table 6, was obtained in the same manner as was the substance in manufacturing example 7, except that silicic soda was added so that the silicon element content relative to iron elements was 0.6% by weight.

Comparative magnetic substance manufacturing example 3

Comparative magnetic substance No. 3, which had the properties shown in Table 6, was obtained in the same manner as was the substance in manufacturing example 7, except that silicic soda was not added.

Comparative magnetic substance manufacturing example 4

Comparative magnetic substance No. 4 , which had the properties shown in Table 6, was obtained in the same manner as was the substance in manufacturing example 7, except that silicic soda was added so that the silicon element content relative to iron elements was 5.5% by weight.

EXAMPLE 20

| | |
|---|---|
| Binder resin (styrene-n-butyl acrylate copolymer, weight-average molecular weight (Mw) of 60,000, number-average molecular weight (Mn) of 5,000, content of THF insoluble residue of 30% by weight) | 100 parts by weight |
| Magnetic substance No. 7 | 100 parts by weight |
| Negative charge control agent (monoazo Fe complex) | 3 parts by weight |
| Release agent (aliphatic alcohol wax $CH_3(CH_2)_nCH_2OH$ average of n: about 50) | 5 parts by weight |

The above substances were employed to produce magnetic toner No. 9, shown in Table 7, in the same manner as was the toner for Example 1. Similarly to Example 1, magnetic toner No. 9 was loaded into the development unit of an improved processing cartridge that was then attached to an LBP printer. Image printing tests were conducted under the conditions for various environments. The results are shown in Table 8.

(1) Image density 10,000 sheets were printed in each of the individual environments, and the image density after printing was compared with the initial image density and evaluated. The image density was measured using a "Macbeth reflection densitometer" (produced by Macbeth Co., Ltd.).

(2) Fogging

The reflectivity (%) indicating the degree of whiteness of a transfer sheet was measured by a reflector meter (produced by Tokyo Denshoku Co., Ltd.), and the reflectivity (%) indicating the degree of whiteness of the transfer sheet was measured after a white solid image was printed on it. The difference between these reflectivities was employed to determine the degree of fogging.

(3) Image quality (sharpness of character lines)

Figure 11:
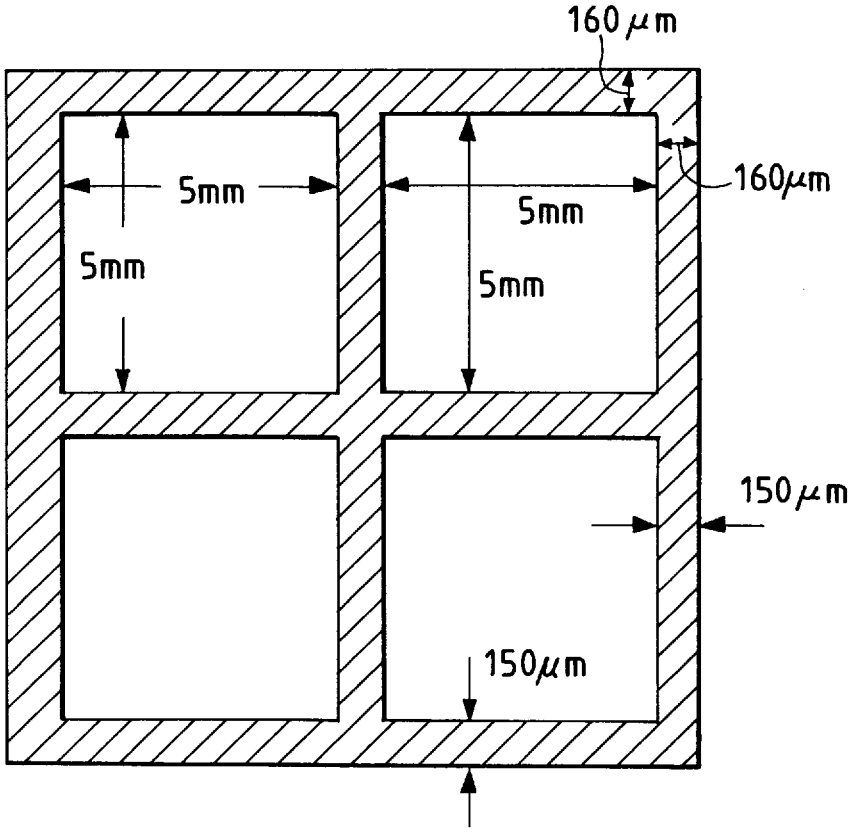
FIG. 11 is an explanatory diagram showing a line image for evaluating the image line definition.

The pattern shown in FIG. 11 was used for the printing, and the pattern definition was evaluated.

| | |
|---|---|
| A: Very superior | 3% or lower for a fluctuation in line width |
| B: Superior | 6% or lower |
| C: Practically usable | 12% or lower |
| D: Poor | higher than 12% |

EXAMPLE 21

| | |
|---|---|
| Binder resin (styrene-n-butyl acrylate copolymer, weight-average molecular weight (Mw) of 65,000, number-average molecular weight (Mn) of 5,800, content of THF insoluble residue of 30% by weight) | 100 parts by weight |
| Magnetic substance No. 7 | 120 parts by weight |
| Negative charge control agent (monoazo Fe complex) | 3 parts by weight |
| Release agent (aliphatic alcohol wax $CH_3(CH_2)_nCH_2OH$ average of n: about 50) | 6 parts by weight |

The above substances were employed to produce magnetic toner No. 10, shown in Table 7, in the same manner as was the toner for Example 1. Image printing tests were conducted under the conditions for various environments in the same manner as were the tests for Example 20. The results are shown in Table 8.

EXAMPLE 22

| | |
|---|---|
| Binder resin (styrene-n-butyl acrylate-n-butyl maleate half ester copolymer, weight-average molecular weight (Mw) of 25,000, number-average molecular weight (Mn) of 8,500) | 100 parts by weight |
| Magnetic substance No. 7 | 90 parts by weight |
| Negative charge control agent (monoazo Fe complex) | 3 parts by weight |
| Release agent (low molecular weight polypropylene wax, Mw of 9,000) | 5 parts by weight |

The above substances were employed to produce magnetic toner No. 11, shown in Table 7, in the same manner as was the toner for Example 1. Image printing tests were conducted under the conditions of various environments in the same manner as were the tests for Example 20. The results are shown in Table 8.

EXAMPLE 23

| | |
|---|---|
| Binder resin (styrene-n-butyl acrylate copolymer, weight-average molecular weight (Mw) of 65,000, number-average molecular weight (Mn) of 5,800, content of THF insoluble residue of 30% by weight) | 100 parts by weight |
| Magnetic substance No. 8 | 100 parts by weight |
| Negative charge control agent (monoazo Fe complex) | 3 parts by weight |
| Release agent (aliphatic alcohol wax $CH_3(CH_2)_nCH_2OH$, average of n: about 50) | 6 parts by weight |

The above substances were employed to produce magnetic toner No. 12, shown in Table 7, in the same manner as was the toner for Example 1. Image printing tests were conducted under the conditions for various environments in the same manner as were the tests for Example 20. The results are shown in Table 8.

EXAMPLE 24

| | |
|---|---|
| Binder resin (styrene-n-butyl acrylate-n-butyl maleate half ester copolymer, weight-average molecular weight (Mw) of 250,000, number-average molecular weight (Mn) of 8,500) | 100 parts by weight |
| Magnetic substance No. 7 | 110 parts by weight |
| Negative charge control agent (monoazo Fe complex) | 3 parts by weight |
| Release agent (low molecular weight polypropylene wax, Mw of 9,000) | 5 parts by weight |

The above substances were employed to produce magnetic toner No. 13, shown in Table 7, in the same manner as was the toner for Example 1. Image printing tests were conducted under the conditions for various environments in the same manner as were the tests for Example 20. The results are shown in Table 8.

EXAMPLE 25

| | |
|---|---|
| Binder resin (styrene-n-butyl acrylate copolymer, weight-average molecular weight (Mw) of 65,000, number-average molecular weight (Mn) of 5,800, content of THF insoluble residue of 30% by weight) | 100 parts by weight |
| Magnetic substance No. 9 | 100 parts by weight |
| Negative charge control agent (monoazo Fe complex) | 3 parts by weight |
| Release agent (aliphatic alcohol wax $CH_3(CH_2)_nCH_2OH$, average of n: about 50) | 6 parts by weight |

The above substances were employed to produce magnetic toner No. 14, shown in Table 7, in the same manner as was the toner for Example 1. Image printing tests were conducted under the conditions for various environments in the same manner as were the tests for Example 20. The results are shown in Table 8.

EXAMPLE 26

| Example 26 | |
|---|---|
| Bnder resin (styrene-n-butyl acrylate-n-butyl maleate half ester copolymer, weight-average molecular weight (Mw) of 250,000, number-average molecular weight (Mn) of 8,500) | 100 parts by weight |
| Magnetic substance No. 7 | 120 parts by weight |
| Negative charge control agent (monoazo Fe complex) | 3 parts by weight |
| Release agent (low molecular weight polypropylene wax, Mw of 9,000) | 5 parts by weight |

The above substances were employed to produce magnetic toner No. 15, shown in Table 7, in the same manner as was the toner for Example 1. Image printing tests were conducted under the conditions for various environments in the same manner as were the tests for Example 20. The results are shown in Table 8.

EXAMPLE 27

| | |
|---|---|
| Binder resin (styrene-n-butyl acrylate copolymer, weight-average molecular weight (Mw) of 65,000, number-average molecular weight (Mn) of 5,800, content of THF insoluble residue of 30% by weight) | 100 parts by weight |
| Magnetic substance No. 10 | 100 parts by weight |
| Negative charge control agent (monoazo Fe complex) | 3 parts by weight |
| Release agent (aliphatic alcohol wax $CH_3(CH_2)_nCH_2OH$, average of n: about 50) | 6 parts by weight |

The above substances were employed to produce magnetic toner No. 16, shown in Table 7, in the same manner as was the toner for Example 1. Image printing tests were conducted under the conditions for various environments in the same manner as were the tests for Example 20. The results are shown in Table 8.

Comparative Example 3

Comparative magnetic toner No. 3, shown in Table 7, was produced in the same manner as was the toner for Example 21, except that the comparative magnetic substance No. 3 was used. Image printing tests were conducted under the conditions for various environments in the same manner as were the tests for Example 20. The results are shown in Table 8.

Comparative Example 4

Comparative magnetic toner No. 4 , shown in Table 7, was produced in the same manner as was the toner for Example 20, except that the comparative magnetic substance No. 3 was used and that polypropylene wax (Mw of 9,000), which has a low molecular weight, was employed as a release agent. Image printing tests were conducted under the conditions for various environments in the same manner as were the tests for Example 20. The results are shown in Table 8.

Comparative Example 5

Comparative magnetic toner No. 5 , shown in Table 7, was produced in the same manner as was the toner for Example 20, except for using comparative magnetic substance No. 4 . Image printing tests were conducted under the conditions for various environments in the same manner as were tests for Example 20. The results are shown in Table 8.

Comparative Example 6

Comparative magnetic toner No. 6, shown in Table 7, was produced in the same manner as was the toner for Example 20, except that comparative magnetic substance No. 4 was used and that polypropylene wax (Mw of 9,000), which has a low molecular weight, was employed as a release agent. Image printing tests were conducted under the conditions for various environments in the same manner as were tests for Example 20. The results are shown in Table 8.

Comparative Example 7

Comparative magnetic toner No. 7, shown in Table 7, for which the weight-average particle diameter was 8.5 $\mu$m, was produced by changing the classification conditions for the manufacture of magnetic toner particles for Example 20. Image printing tests were conducted under the conditions for various environments in the same manner as were the tests for Example 20. The results are shown in Table 8.

Comparative Example 8

Comparative magnetic toner No. 8, shown in Table 7, for which the weight-average particle diameter was 3.0 $\mu$m, was produced by changing the classification conditions at the manufacture of magnetic toner particles for Example 20. Image printing tests were conducted under the conditions for various environments in the same manner as were the tests for Example 20. The results are shown in Table 8.

Comparative Example 9

Comparative magnetic toner No. 9, shown in Table 7, for which the weight-average particle diameter was 6.0 $\mu$m and for which content Y of particles of 3.17 $\mu$m or smaller was 3.1% by number, was produced by changing the classification conditions at the manufacture of magnetic toner particles for Example 20. Image printing tests were conducted under the conditions for various environments in the same manner as were tests for Example 20. The results are shown in Table 8.

Comparative Example 10

Comparative magnetic toner No. 10, shown in Table 7, for which the weight-average particle diameter was 5.6 $\mu$m and for which content Y of particles of 3.17 $\mu$m or smaller was 41.1% by number, was produced by changing the classification conditions at the manufacture of magnetic toner particles for Example 20. Image printing tests were conducted under the conditions for various environments in the same manner as were tests for Example 20. The results are shown in Table 8.

TABLE 1

| | Value in magnetic field of 795.8 KA/m (10K oersted) | | | | Silicon compound content (weight %) | Amount W (weight %) silicon dioxide on | Average particle | | Magnetic substance |
|---|---|---|---|---|---|---|---|---|---|
| | σr (Am/kg) | Hc (kA/m) | σr × Hc | Sphericity (ψ) | (silicone element calculation) | magnetic substance surface | diameter (μm) R | W × R | volume specific resistance (Ω · cm) |
| Magnetic substance No. 1 | 5.0 | 5.2 | 26 | 0.99 | 2.8 | 0.20 | 0.20 | 0.039 | $9 \times 10^5$ |
| Magnetic substance No. 2 | 5.9 | 6.4 | 38 | 0.99 | 1.3 | 0.22 | 0.18 | 0.039 | $2 \times 10^6$ |
| Magnetic substance No. 3 | 5.9 | 6.4 | 38 | 0.99 | 1.3 | 0.13 | 0.18 | 0.024 | $2 \times 10^5$ |
| Magnetic substance No. 4 | 7.3 | 7.1 | 52 | 0.99 | 0.6 | 0.08 | 0.15 | 0.012 | $8 \times 10^4$ |
| Magnetic substance No. 5 | 5.5 | 5.5 | 30 | 0.98 | 2.0 | 0.20 | 0.20 | 0.039 | $7 \times 10^5$ |
| Magnetic substance No. 6 | 5.0 | 5.8 | 24 | 0.97 | 3.7 | 0.20 | 0.22 | 0.045 | $8 \times 10^5$ |
| Comparative magnetic substance No. 1 | 3.0 | 3.0 | 9 | 0.94 | 5.7 | 1.84 | 0.25 | 0.460 | $3 \times 10^7$ |
| Comparative magnetic substance No. 2 | 10.0 | 8.7 | 87 | 0.69 | 0.02 | 0.003 | 0.31 | 0.001 | $2 \times 10^3$ |

TABLE 2

| | Magnetic property value of magnetic toner in magnetic field of 795.8 KA/w (10K oersted) | | | Weight magnetic toner, average | Number % Y, particles diameter 3.15 μm | Number % Z, particles diameter 2.52 μm | Magnetic toner void | Magnetic toner tribo-electrification |
|---|---|---|---|---|---|---|---|---|
| | $\sigma_r$ (Am/kg) | $H_c$ (kA/m) | $\sigma_r \times H_c$ | diameter X (μm) | or smaller | or smaller | rate | property |
| Example 1 | 2.4 | 2.5 | 6.0 | 5.7 | 16.5 | 3.8 | 0.57 | 32 |
| Example 2 | 2.9 | 3.1 | 9.0 | 3.7 | 32.5 | 20.1 | 0.63 | 40 |
| Example 3 | 2.9 | 3.1 | 9.0 | 6.3 | 6.0 | 0.2 | 0.50 | 28 |
| Example 4 | 3.5 | 3.4 | 11.9 | 6.4 | 19.0 | 5.4 | 0.52 | 29 |
| Example 5 | 2.7 | 2.7 | 7.3 | 4.9 | 21.5 | 11.5 | 0.59 | 37 |
| Example 6 | 2.5 | 2.3 | 5.8 | 6.2 | 20.5 | 8.0 | 0.53 | 29 |
| Example 7 | 2.5 | 2.3 | 5.8 | 5.4 | 9.5 | 3.3 | 0.59 | 26 |
| Example 8 | 2.5 | 2.3 | 5.8 | 6.4 | 5.0 | 1.5 | 0.49 | 30 |
| Comparative Example 1 | 1.4 | 1.4 | 2.0 | 7.6 | 4.8 | 1.2 | 0.40 | 19 |
| Comparative Example 2 | 4.8 | 4.2 | 20.2 | 5.7 | 16.0 | 4.3 | 0.50 | 30 |

TABLE 3

| | Low-temperature and low-humidity environment (15° C., 10% RH) | | | Normal-temperature and normal-humidity environment (25° C., 60% RH) | | | High-temperature and high-humidity environment (32° C., 85% RH) | | | |
|---|---|---|---|---|---|---|---|---|---|---|
| | Solid black image density | Fogging | Character sharpness | Solid black image density | Fogging | Character sharpness | Solid black image density | Fogging | Character sharpness | Toner fusion to drum surface |
| Example 1 | 1.35 | 0.5 | A | 1.40 | 0.4 | A | 1.39 | 0.4 | A | 5 |
| Exmaple 2 | 1.40 | 0.5 | A | 1.42 | 0.5 | A | 1.42 | 0.4 | A | 5 |
| Example 3 | 1.40 | 0.4 | A | 1.42 | 0.3 | A | 1.39 | 0.3 | A | 5 |
| Example 4 | 1.36 | 0.9 | B | 1.37 | 0.8 | B | 1.36 | 0.7 | B | 5 |
| Example 5 | 1.40 | 0.5 | A | 1.42 | 0.4 | A | 1.40 | 0.4 | A | 5 |
| Example 6 | 1.35 | 0.9 | A | 1.39 | 0.8 | A | 1.37 | 0.6 | A | 4 |
| Example 7 | 1.35 | 0.4 | A | 1.37 | 0.4 | A | 1.38 | 0.3 | B | 4 |
| Example 8 | 1.35 | 0.4 | B | 1.38 | 0.4 | B | 1.38 | 0.3 | B | 4 |

TABLE 3-continued

| | Low-temperature and low-humidity environment (15° C., 10% RH) | | | Normal-temperature and normal-humidity environment (25° C., 60% RH) | | | High-temperature and high-humidity environment (32° C., 85% RH) | | | |
|---|---|---|---|---|---|---|---|---|---|---|
| | Solid black image density | Fogging | Character sharpness | Solid black image density | Fogging | Character sharpness | Solid black image density | Fogging | Character sharpness | Toner fusion to drum surface |
| Comparative example 1 | 1.35 | 1.5 | D | 1.32 | 1.3 | D | 1.18 | 1.1 | D | 1 |
| Comparative example 2 | 1.05 | 2.0 | C | 1.15 | 1.8 | C | 1.08 | 1.7 | C | 3 |

TABLE 4

| | Development Sleeve | | | Drawing pressure (gf) | Fixed Magnet | | |
|---|---|---|---|---|---|---|---|
| | Base material | Resin coat layer presence/absence | Surface at center line, average roughness $R_a$ ($\mu$m) | between elastic blade and development sleeve | 1st magnetic pole (gauss) | 2nd magnetic pole (gauss) | 3rd magnetic pole (gauss) |
| Example 9 | Aluminum tube | Present | 0.3 | 25 | 700 | 750 | 850 |
| Example 10 | Aluminum tube | Present | 2.5 | 25 | 720 | 750 | 850 |
| Example 11 | Aluminum tube | Present | 1.5 | 5 | 700 | 750 | 850 |
| Example 12 | Aluminum tube | Present | 1.5 | 50 | 700 | 750 | 850 |
| Example 13 | Aluminum tube | Present | 1.7 | 25 | 520 | 600 | 850 |
| Example 14 | Aluminum tube | Present | 1.8 | 25 | 870 | 950 | 850 |
| Example 15 | Aluminum tube | Present | 1.7 | 25 | 700 | 750 | 700 |
| Example 16 | Aluminum tube | Present | 1.7 | 25 | 700 | 750 | 1000 |
| Example 17 | Aluminum tube | Absent | 1.8 | 25 | 700 | 750 | 850 |
| Example 18 | SUS tube | Absent | 2.0 | 25 | 700 | 750 | 850 |
| Example 19 | Aluminum tube | Present | 1.8 | Used magnetic blade, gap with development sleeve 250 $\mu$m | 700 | 750 | 850 |

TABLE 5

| | Low-temperature/low-humidity environment (15° C., 10% RH) | | | Normal-temperature/normal-humidity environment (25° C., 60% RH) | | | High-temperature/high-humidity environment (32° C., 85% RH) | | | |
|---|---|---|---|---|---|---|---|---|---|---|
| | Solid black image density | Fogging | Character sharpness | Solid black image density | Fogging | Character sharpness | Solid black image density | Fogging | Character sharpness | Toner fusion to drum surface |
| Example 9 | 1.32 | 0.8 | A | 1.37 | 0.7 | A | 1.37 | 0.6 | A | 5 |
| Example 10 | 1.36 | 0.5 | A | 1.33 | 0.4 | B | 1.32 | 0.3 | B | 5 |
| Example 11 | 1.33 | 0.5 | A | 1.31 | 0.3 | A | 1.30 | 0.3 | B | 5 |
| Example 12 | 1.31 | 0.8 | B | 1.34 | 0.7 | A | 1.37 | 0.7 | A | 5 |
| Example 13 | 1.36 | 0.6 | A | 1.35 | 0.6 | A | 1.33 | 0.5 | B | 5 |
| Example 14 | 1.34 | 0.9 | A | 1.33 | 0.9 | A | 1.31 | 0.8 | A | 5 |
| Example 15 | 1.42 | 0.9 | A | 1.41 | 0.9 | A | 1.40 | 0.8 | B | 5 |
| Example 16 | 1.33 | 0.3 | A | 1.32 | 0.3 | A | 1.31 | 0.3 | A | 5 |
| Example 17 | 1.38 | 0.6 | B | 1.37 | 0.6 | B | 1.36 | 0.6 | B | 4 |

TABLE 5-continued

| | Low-temperature/low-humidity environment (15° C., 10% RH) | | | Normal-temperature/normal-humidity environment (25° C., 60% RH) | | | High-temperature/high-humidity environment (32° C., 85% RH) | | | |
|---|---|---|---|---|---|---|---|---|---|---|
| | Solid black image density | Fogging | Character sharpness | Solid black image density | Fogging | Character sharpness | Solid black image density | Fogging | Character sharpness | Toner fusion to drum surface |
| Example 18 | 1.32 | 0.8 | B | 1.31 | 0.7 | B | 1.31 | 0.6 | B | 4 |
| Example 19 | 1.31 | 0.6 | B | 1.30 | 0.5 | B | 1.29 | 0.3 | B | 5 |

TABLE 6

| | Value in magnetic field of 795.8 KA/m (10K oersted) | | | | Silicon compound content (weight %) | Amount W (weight %) silicon dioxide on | Average particle | | Magnetic substance |
|---|---|---|---|---|---|---|---|---|---|
| | σr (Am/kg) | Hc (kA/m) | σr × Hc | Sphericity (ψ) | (silicone element calculation) | magnetic substance surface | diameter (μm) R | W × R | volume specific resistance (Ω · cm) |
| Magnetic substance No. 7 | 6.3 | 5.5 | 34.7 | 0.95 | 1.1 | 0.10 | 0.18 | 0.018 | $1 \times 10^5$ |
| Magnetic substance No. 8 | 5.3 | 4.7 | 24.9 | 0.90 | 3.0 | 0.19 | 0.22 | 0.042 | $7 \times 10^5$ |
| Magnetic substance No. 9 | 4.0 | 38 | 15.2 | 0.99 | 3.8 | 0.25 | 0.24 | 0.060 | $9 \times 10^5$ |
| Magnetic substance No. 10 | 8.0 | 6.7 | 53.6 | 0.82 | 0.5 | 0.06 | 0.13 | 0.008 | $7 \times 10^4$ |
| Comparative magnetic substance No. 3 | 15.0 | 13.2 | 198.0 | 0.56 | 0.0 | 0.00 | 0.26 | 0.000 | $1 \times 10^3$ |
| Comparative magnetic substance No. 4 | 2.9 | 3.1 | 9.0 | 0.98 | 5.3 | 1.72 | 0.31 | 0.533 | $2 \times 10^7$ |

TABLE 7

| | Magnetic property value of magnetic toner in magnetic field of 795.8 KA/w (10K oersted) | | | Weight magnetic toner, average | Number % Y, particles diameter 3.15 μm | Number % Z, particles diameter 2.52 μm | Magnetic toner void | Magnetic toner tribo-electrification |
|---|---|---|---|---|---|---|---|---|
| | $\sigma_r$ (Am/kg) | $H_c$ (kA/m) | $\sigma_r \times H_c$ | diameter X (μm) | or smaller | or smaller | rate | property |
| Example 20 | 3.0 | 2.6 | 7.8 | 5.7 | 13.5 | 3.7 | 0.58 | 33 |
| Example 21 | 3.3 | 2.9 | 9.6 | 5.7 | 15.5 | 3.8 | 0.58 | 25 |
| Example 22 | 2.9 | 2.5 | 7.3 | 5.8 | 14.5 | 3.7 | 0.57 | 37 |
| Example 23 | 2.5 | 2.2 | 5.5 | 5.7 | 14.5 | 3.6 | 0.58 | 32 |
| Example 24 | 3.2 | 2.8 | 9.0 | 5.6 | 14.8 | 3.3 | 0.57 | 28 |
| Example 25 | 1.9 | 1.8 | 3.4 | 5.7 | 16.5 | 3.8 | 0.58 | 33 |
| Example 26 | 3.3 | 2.9 | 9.6 | 5.8 | 15.5 | 3.6 | 0.57 | 25 |
| Example 27 | 3.8 | 3.2 | 12.2 | 5.6 | 16.0 | 3.7 | 0.56 | 33 |
| Comparative Example 3 | 7.2 | 6.3 | 45.4 | 5.8 | 13.2 | 3.3 | 0.58 | 30 |
| Comparative Example 4 | 7.2 | 6.3 | 45.4 | 5.6 | 13.8 | 3.9 | 0.58 | 30 |
| Comparative Example 5 | 1.4 | 1.5 | 2.1 | 5.7 | 13.6 | 3.8 | 0.58 | 37 |
| Comparative Example 6 | 1.4 | 1.5 | 2.1 | 5.8 | 13.3 | 3.4 | 0.58 | 37 |
| Comparative Example 7 | 3.0 | 2.6 | 7.8 | 8.5 | 3.0 | 0.2 | 0.38 | 13 |
| Comparative Example 8 | 3.0 | 2.6 | 7.8 | 3.0 | 41.5 | 25.0 | 0.71 | 49 |
| Comparative Example 9 | 3.0 | 2.6 | 7.8 | 6.0 | 3.1 | 0.1 | 0.49 | 24 |
| Comparative Example 10 | 3.0 | 2.6 | 7.8 | 5.6 | 41.1 | 15.5 | 0.61 | 45 |

TABLE 8

| | Solid black image density | | | Fogging after printing 5000 sheets | | | Linear image quality after printing 5000 sheets | | |
|---|---|---|---|---|---|---|---|---|---|
| | Normal temperature, humidity | Low temperature, humidity | High temperature, humidity | Normal temperature, humidity | Low temperature, humidity | High temperature, humidity | Normal temperature, humidity | Low temperature, humidity | High temperature, humidity |
| Example 20 | 1.42 | 1.42 | 1.40 | 0.4 | 0.5 | 0.4 | A | A | A |
| Example 21 | 1.40 | 1.41 | 1.38 | 0.4 | 0.5 | 0.2 | A | A | B |
| Example 22 | 1.40 | 1.39 | 1.40 | 0.6 | 0.7 | 0.5 | A | A | A |
| Example 23 | 1.41 | 1.40 | 1.40 | 0.4 | 0.5 | 0.4 | A | A | A |
| Example 24 | 1.41 | 1.40 | 1.40 | 0.4 | 0.5 | 0.4 | A | A | A |
| Example 25 | 1.42 | 1.42 | 1.40 | 0.4 | 0.5 | 0.3 | A | A | B |
| Example 26 | 1.40 | 1.41 | 1.38 | 0.4 | 0.5 | 0.2 | A | A | A |
| Example 27 | 1.39 | 1.40 | 1.37 | 0.8 | 0.9 | 0.6 | A | A | A |
| Comparative example 3 | 1.15 | 1.20 | 1.05 | 2.0 | 2.2 | 1.6 | C | C | C |
| Comparative example 4 | 1.13 | 1.19 | 1.03 | 2.2 | 2.4 | 1.8 | C | C | C |
| Comparative example 5 | 1.33 | 1.36 | 1.30 | 1.3 | 1.6 | 1.1 | D | D | D |
| Comparative example 6 | 1.31 | 1.34 | 1.28 | 1.2 | 1.4 | 1.1 | D | D | D |
| Comparative example 7 | 1.06 | 1.09 | 1.02 | 1.0 | 1.3 | 0.8 | D | D | D |
| Comparative example 8 | 1.05 | 1.08 | 1.01 | 1.0 | 1.5 | 0.9 | C | D | C |
| Comparative example 9 | 1.25 | 1.25 | 1.22 | 0.6 | 0.7 | 0.5 | D | D | D |
| Comparative example 10 | 1.25 | 1.23 | 1.25 | 2.0 | 2.5 | 1.5 | D | D | C |

What is claimed is:

1. A magnetic toner for developing an electrostatic latent image, comprising magnetic toner particles consisting of a binder resin of 100 parts by weight and a magnetic substance of 20 to 150 parts by weight, wherein a frictional electrification property is such that the absolute value of the frictional electrification amount relative to an iron powder of 250 mesh-pass to 350 mesh-on is 25 to 40 mc/kg;

assuming that for particle distribution of said magnetic toner a weight-average particle diameter ($D_4$) of said magnetic toner is X ($\mu$m), and that a % by number in a number distribution of magnetic toner particles that have a diameter of 3.17 $\mu$m or smaller is Y (%), expressions (1) and (2) are satisfied:

$$-5X+35 \leqq Y \leqq -25X+180 \quad (1)$$

$$3.5 \leqq X \leqq 6.5 \quad (2)$$

sphericity ($\psi$) of said magnetic substance is equal to or greater than 0.80; and a product ($\sigma_r \times H_c$) of remanence [$\sigma_r$ ($Am^2/kg$)] and coercive force [$H_c$ (kA/m)] of said magnetic substance in a magnetic field of 795.8 kA/m (10 k oersted) is 10 to 56 ($kA^2m/kg$).

2. The magnetic toner according to claim 1, wherein a product ($\sigma_r \times H_c$) of remanence [$\sigma_r$ ($Am^2/kg$)] and coercive force [$H_c$ (kA/m)] of said magnetic substance in a magnetic field of 795.8 kA/m (10 k oersted) is 24 to 56 ($kA^2m/kg$).

3. The magnetic toner according to claim 1, wherein remanence ($\sigma_r$) of said magnetic substance is 3.1 to 9.1 ($Am^2/kg$) and coercive force ($H_c$) is 3.3 to 8.3 (kA/m) in a magnetic field of 795.8 kA/m (10 k oersted).

4. The magnetic toner according to claim 1, wherein a product ($\sigma_r \times H_c$) of remanence [$\sigma_r$ ($Am^2/kg$)] and coercive force [$H_c$ (kA/m)] of said magnetic substance in a magnetic field of 795.8 kA/m (10 k oersted) is 30 to 52 ($kA^2m/kg$).

5. The magnetic toner according to claim 1, wherein said magnetic substance contains a silicon compound and the content of said silicon compound when calculated as silicon elements is 0.1 to 4.0% by weight with reference to the content of iron elements in said magnetic substance.

6. The magnetic toner according to claim 1, wherein sphericity ($\psi$) of said magnetic substance is 0.85 or higher.

7. The magnetic toner according to claim 1, wherein silicon dioxide exists on a surface of said magnetic substance, and assuming that % by weight of silicon dioxide existing on said surface of said magnetic substance is W (% by weight) and that a number-average particle diameter for said magnetic substance is R ($\mu$m), a value for W×R is 0.003 to 0.042.

8. The magnetic toner according to claim 7, wherein % by weight of silicon dioxide existing on said surface of said magnetic substance is 0.06 to 0.50% by weight and said number-average particle diameter for said magnetic substance is 0.05 to 0.30 $\mu$m.

9. The magnetic toner according to claim 1, wherein a volume specific resistance of said magnetic substance is $1\times10^4$ to $1\times10^7$ $\Omega\cdot$cm.

10. The magnetic toner according to claim 1, wherein a volume specific resistance of said magnetic substance is $5\times10^4$ to $5\times10^6$ $\Omega\cdot$cm.

11. The magnetic toner according to claim 1, wherein said magnetic toner has a particle distribution that satisfies expression (3):

$$-5X+35 \leqq Y \leqq -12.5X+98.75 \quad (3).$$

12. The magnetic toner according to claim 1, wherein a weight-average particle diameter ($D_4$) for said magnetic toner is 4.0 to 6.3 $\mu$m.

13. The magnetic toner according to claim 1, wherein, assuming that for particle distribution of said magnetic toner a weight-average particle diameter ($D_4$) of said magnetic toner is X ($\mu$m), and that a % by number in a number distribution of said magnetic toner particles of 2.52 $\mu$m or smaller is Z (%), expression (4) is satisfied:

$$-7.5X+45 \leqq Z \leqq -12.0X+82 \quad (4).$$

14. The magnetic toner according to claim 1, wherein a void ratio of said magnetic toner acquired from a tap density is 0.45 to 0.70.

15. An apparatus unit that is capable of being detached from a main body of an image forming apparatus, comprising a development unit having a container in which frictional electrification magnetic toner is held, a development sleeve for feeding said magnetic toner, and a toner layer thickness regulating member for coating said toner on said development sleeve while pressing said development sleeve, wherein said magnetic toner is composed of magnetic toner particles containing a magnetic substance of 20 to 150 parts by weight for a binder resin of 100 parts by weight;

said magnetic toner has a frictional electrification property whereof an absolute value for a frictional electrification amount relative to iron powder of 250 mesh-pass to 350 mesh-on is 25 to 40 mc/kg;

assuming that a weight-average particle diameter ($D_4$) of said magnetic toner in a particle distribution of said magnetic toner is X ($\mu$m) and that a % by number in a number distribution of said magnetic toner particles that have a diameter of 3.17 $\mu$m or smaller is Y (%), expressions (1) and (2) are satisfied $$-5X+35 \leqq Y \leqq -25X+180 \quad (1)$$

$$3.5 \leqq X \leqq 6.5 \quad (2);$$

sphericity ($\psi$) of said magnetic substance is 0.80 or greater and a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 10 to 56 ($kA^2m$/kg);

in said development sleeve is provided a fixed magnet, which has at least a first magnetic pole of 520 to 870 gauss that is positioned opposite a magnetic toner mixing member located in said container, a second magnetic pole of 600 to 950 gauss that is positioned opposite said toner layer thickness regulating member, and a third magnetic pole of 700 to 1000 gauss that is a development magnetic pole; and a center line average roughness ($R_a$) of a surface of said development sleeve is 0.3 to 2.5 $\mu$m.

16. The apparatus unit according to claim 15, wherein a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 24 to 56 ($kA^2m$/kg).

17. The apparatus unit according to claim 15, wherein remanence ($\sigma_r$) of said magnetic substance is 3.1 to 9.1 ($Am^2$/kg) and coercive force ($H_c$) is 3.3 to 8.3 (kA/m) in a magnetic field of 795.8 kA/m (10 k oersted).

18. The apparatus unit according to claim 15, wherein a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 30 to 52 ($kA^2m$/kg).

19. The apparatus unit according to claim 15, wherein said magnetic substance contains a silicon compound and the content of said silicon compound when calculated as silicon elements is 0.1 to 4.0% by weight with reference to the content of iron elements in said magnetic substance.

20. The apparatus unit according to claim 15, wherein sphericity ($\psi$) of said magnetic substance contained in said magnetic toner particles is 0.85 or higher.

21. The apparatus unit according to claim 15, wherein silicon dioxide exists on a surface of said magnetic substance, and assuming that % by weight of silicon dioxide existing on said surface of said magnetic substance is W (% by weight) and that a number-average particle diameter for said magnetic substance is R ($\mu$m), a value for W×R is 0.003 to 0.042.

22. The apparatus unit according to claim 21, wherein % by weight of silicon dioxide existing on said surface of said magnetic substance is 0.06 to 0.50% by weight and said number-average particle diameter for said magnetic substance is 0.05 to 0.30 $\mu$m.

23. The apparatus unit according to claim 15, wherein a volume specific resistance of said magnetic substance is $1\times10^4$ to $1\times10^7$ $\Omega$·cm.

24. The apparatus unit according to claim 15, wherein a volume specific resistance of said magnetic substance is $5\times10^4$ to $5\times10^6$ $\Omega$·cm.

25. The apparatus unit according to claim 15, wherein said magnetic toner has a particle distribution that satisfies expression (3):

$$-5X+35 \leqq Y \leqq -12.5X+98.75 \quad (3).$$

26. The apparatus unit according to claim 15, wherein a weight-average particle diameter ($D_4$) for said magnetic toner is 4.0 to 6.3 $\mu$m.

27. The apparatus unit according to claim 15, wherein, assuming that for particle distribution of said magnetic toner a weight-average particle diameter ($D_4$) of said magnetic toner is X ($\mu$m), and that a % by number in a number distribution of said magnetic toner particles of 2.52 $\mu$m or smaller is Z (%), expression (4) is satisfied:

$$-7.5X+45 \leqq Z \leqq -12.0X+82 \quad (4).$$

28. The apparatus unit according to claim 15, wherein a void ratio of said magnetic toner acquired from a tap density is 0.45 to 0.70.

29. The apparatus unit according to claim 15, wherein a diameter of said development sleeve is 10 to 30 mm, and a diameter of said fixed magnet internally provided in said development sleeve is 7 to 28 mm.

30. The apparatus unit according to claim 15, wherein said development sleeve is formed of a cylindrical aluminum tube and a resin coated layer that covers a surface of said cylindrical aluminum tube.

31. The apparatus unit according to claim 30, wherein said resin coated layer contains conductive powder of 15 to 60% by weight.

32. The apparatus unit according to claim 31, wherein said conductive powder is carbon black or graphite.

33. The apparatus unit according to claim 15, wherein said toner layer thickness restriction member is an elastic blade, which is pressed against said development sleeve so that a drawing pressure measured by using a SUS thin film is 5 to 50 (gf).

34. The apparatus unit according to claim 15, wherein said development unit is integrally formed, as a cartridge, with an electrostatic latent image bearing member.

35. The apparatus unit according to claim 15, wherein said development unit is integrally formed, as a cartridge, with an electrostatic latent image bearing member and electrification means for charging said electrostatic latent image bearing member.

36. The apparatus unit according to claim 15, wherein said development unit is integrally formed, as a cartridge, with an electrostatic latent image bearing member, electrification means for charging said electrostatic latent image bearing member, and cleaning means for cleaning a surface of said electrostatic latent image bearing member.

37. An image forming method, comprising the steps of:

charging an electrostatic latent image bearing member by using electrification means, forming an electrostatic latent image by exposing said electrified electrostatic latent image bearing member, developing said electrostatic latent image to form a magnetic toner image by using a development unit, which is positioned opposite said electrostatic latent image bearing member, transferring said magnetic toner image to a transfer material by using or without using an intermediate transfer member, and fixing said magnetic toner image to said transfer material;

wherein said development unit has a container in which frictional electrification magnetic toner is retained, a development sleeve for feeding said magnetic toner, and a toner layer thickness regulating member for coating said magnetic toner on said development sleeve while pressing against said development sleeve;

said magnetic toner is composed of magnetic toner particles containing a magnetic substance of 20 to 150 parts by weight for a binder resin of 100 parts by weight;

said magnetic toner has a frictional electrification property such that the absolute value of a frictional electrification amount relative to iron powder of 250 mesh-pass to 350 mesh-on is 25 to 40 mc/kg;

assuming that a weight-average particle diameter ($D_4$) of said magnetic toner in a particle distribution of said magnetic toner is X ($\mu$m) and that % by number in a number distribution of said magnetic toner particles having a diameter of 3.17 $\mu$m or smaller is Y (%), expressions (1) and (2) below are satisfied $$-5X+35 \leqq Y \leqq -25X+180 \quad (1)$$

$$3.5 \leqq X \leqq 6.5 \quad (2);$$

sphericity ($\psi$) of said magnetic substance is 0.80 or greater and a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 10 to 56 ($kA^2m$/kg);

in said development sleeve is provided a fixed magnetic, which has at least a first magnetic pole of 520 to 870 gauss that is positioned opposite a magnetic toner mixing member located in said container, a second magnetic pole of 600 to 950 gauss that is positioned opposite said toner layer thickness regulating member, and a third magnetic pole of 700 to 1000 gauss that is a development magnetic pole; and a center line average roughness ($R_a$) of a surface of said development sleeve is 0.3 to 2.5 $\mu$m.

38. The method according to claim 37, wherein a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 24 to 56 ($kA^2m$/kg).

39. The method according to claim 37, wherein remanence ($\sigma_r$) of said magnetic substance is 3.1 to 9.1 ($Am^2$/kg) and coercive force ($H_c$) is 3.3 to 8.3 (kA/m) in a magnetic field of 795.8 kA/m (10 k oersted).

40. The method according to claim 37, wherein a product ($\sigma_r \times H_c$) of remanence [$\sigma_r$ ($Am^2$/kg)] and coercive force [$H_c$ (kA/m)] of said magnetic substance in a magnetic field of 795.8 kA/m (10 k oersted) is 30 to 52 ($kA^2m$/kg).

41. The method according to claim 37, wherein said magnetic substance contains a silicon compound and the content of said silicon compound when calculated as silicon elements is 0.1 to 4.0% by weight with reference to the content of iron elements in said magnetic substance.

42. The method according to claim 37, wherein sphericity ($\psi$) of said magnetic substance contained in said magnetic toner particles is 0.85 or higher.

43. The method according to claim 37, wherein silicon dioxide exists on a surface of said magnetic substance, and assuming that % by weight of silicon dioxide existing on said surface of said magnetic substance is W (% by weight) and that a number-average particle diameter for said magnetic substance is R ($\mu$m), a value for W×R is 0.003 to 0.042.

44. The method according to claim 37, wherein % by weight of silicon dioxide existing on said surface of said magnetic substance is 0.06 to 0.50% by weight and said number-average particle diameter for said magnetic substance is 0.05 to 0.30 $\mu$m.

45. The method according to claim 37, wherein a volume specific resistance of said magnetic substance is $1\times10^4$ to $1\times10^7$ $\Omega\cdot$cm.

46. The method according to claim 37, wherein a volume specific resistance of said magnetic substance is $5\times10^4$ to $5\times10^6$ $\Omega\cdot$cm.

47. The method according to claim 37, wherein said magnetic toner has a particle distribution that satisfies expression (3):

$$-5X+35 \leqq Y \leqq -12.5X+98.75 \quad (3).$$

48. The method according to claim 37, wherein a weight-average particle diameter ($D_4$) for said magnetic toner is 4.0 to 6.3 $\mu$m.

49. The method according to claim 37, wherefore, assuming that for particle distribution of said magnetic toner a weight-average particle diameter ($D_4$) of said magnetic toner is X ($\mu$m), and that a % by number in a number distribution of said magnetic toner particles of 2.52 $\mu$m or smaller is Z (%), expression (4) is satisfied:

$$-7.5X+45 \leqq Z \leqq -12.0X+82 \quad (4).$$

50. The method according to claim 37, wherein a void ratio of said magnetic toner acquired from a tap density is 0.45 to 0.70.

51. The method according to claim 37, wherein a diameter of said development sleeve is 10 to 30 mm, and a diameter of said fixed magnet internally provided in said development sleeve is 7 to 28 mm.

52. The method according to claim 37, wherein said development sleeve is formed of a cylindrical aluminum tube and a resin coated layer that covers a surface of said cylindrical aluminum tube.

53. The method according to claim 37, wherein said resin coated layer contains conductive powder of 15 to 60% by weight.

54. The method according to claim 53, wherein said conductive powder is carbon black or graphite.

55. The method according to claim 37, wherein said toner layer thickness restriction member is an elastic blade, which is pressed against said development sleeve so that a drawing pressure measured by using a SUS thin film is 5 to 50 (gf).

56. The method according to claim 37, wherein said electrostatic latent image bearing member is electrified by contact charging means to which a bias voltage is applied.

57. The method according to claim 56, wherein said electrostatic latent image bearing member is electrified by a charging roller to which a bias voltage is applied.

58. The method according to claim 56, wherein said electrostatic latent image bearing member is electrified by a charging brush to which a bias voltage is applied.

59. The method according to claim 56, wherein said electrostatic latent image bearing member is electrified by a charging blade to which a bias voltage is applied.

60. The method according to claim 37, wherein said electrostatic latent image is a digital latent image, and said digital latent image is developed by an inversion development method, and a magnetic toner image is formed on said electrostatic latent image bearing member.

61. The method according to claim 37, wherein a surface layer of said electrostatic latent image bearing member is a resin layer.

62. The method according to claim 37, wherein said magnetic toner image on said electrostatic latent image bearing member is transferred to a transfer medium by contact transfer means to which a bias voltage is applied.

63. The method according to claim 62, wherein said magnetic toner image on said electrostatic latent image bearing member is transferred to a transfer medium by a transfer roller to which a bias voltage is applied.

64. The method according to claim 62, wherein said magnetic toner image on said electrostatic latent image bearing member is transferred to a transfer medium by a transfer belt to which a bias voltage is applied.

65. The method according to claim 37, wherein, after a transfer procedure is completed, said electrostatic latent image bearing member is cleaned by cleaning means.

66. The method according to claim 65, wherein said cleaning means is a cleaning blade.

* * * * *

UNITED STATES PATENT AND TRADEMARK OFFICE

CERTIFICATE OF CORRECTION

PATENT NO. : 5,858,593

DATED : January 12 ,1999

INVENTOR(S) : OSAMU TAMURA ET AL.

It is certified that error appears in the above-identified patent and that said Letters Patent is hereby corrected as shown below:

COLUMN 2

Line 15, "occur" should read --occurs--.
Line 53, "$3.5 \leq X < 6.5$" should read --$3.5 \leq X \leq 6.5$--.

COLUMN 4

Line 9, "$3.5 \leq X < 6.5$" should read --$3.5 \leq X \leq 6.5$--.
Line 16, "magnetic," should read --magnet,--.

COLUMN 5

Line 6, "$X > 3.5$," should read --$X < 3.5$,--.
Line 19, "satisfy" should read --satisfy the--.
Line 55, "56 $kA^2Am/kg$," should read --56 $kA^2m/kg$,--.
Line 59, "10 $kA^2m/kg$ is employed," should read --10 $kA^2m/kg$,--.

UNITED STATES PATENT AND TRADEMARK OFFICE

CERTIFICATE OF CORRECTION

PATENT NO. : 5,858,593

DATED : January 12 ,1999

INVENTOR(S) : OSAMU TAMURA ET AL.

It is certified that error appears in the above-identified patent and that said Letters Patent is hereby corrected as shown below:

COLUMN 6

Line 10, "be" should be deleted.
Line 15, "elements" should read --element--.
Line 18, "iron elements" should read --iron element--.

COLUMN 8

Line 40, "dimethancrylate" should read --dimethacrylate-.

COLUMN 11

Line 4, "silicon" should read --silicone--.
Line 17, "a" should be deleted.
Line 34, "example" should read --example of a--.

COLUMN 12

Line 41, "flow" should read --flows--.
Line 51, "gains" should read --grains--.

UNITED STATES PATENT AND TRADEMARK OFFICE

CERTIFICATE OF CORRECTION

PATENT NO. : 5,858,593

DATED : January 12 ,1999

INVENTOR(S) : OSAMU TAMURA ET AL.

It is certified that error appears in the above-identified patent and that said Letters Patent is hereby corrected as shown below:

COLUMN 13

Line 58, "example" should read --example of a--.

COLUMN 16

Line 18, "Method" should read --¶ Method--.
Line 28, "elements" should read --element--.
Line 29, "elements." should read --element.--.

COLUMN 17

Line 16, "(1)" should read --¶ (1)--.
Line 53, "(having" should read --having a--.
Line 60, "Method" should read --¶ Method--.

COLUMN 18

Line 10 "value is" should read --value--.
Line 34, "elements" should read --element--.
Line 46, "Magnetic" should read --¶ Magnetic--.
Line 49, "Magnetic" should read --¶ Magnetic--.

UNITED STATES PATENT AND TRADEMARK OFFICE

CERTIFICATE OF CORRECTION

PATENT NO. : 5,858,593

DATED : January 12 ,1999

INVENTOR(S) : OSAMU TAMURA ET AL.

It is certified that error appears in the above-identified patent and that said Letters Patent is hereby corrected as shown below:

COLUMN 19

Line 5, "a 1.5" should read --1.5--.
Line 7, "a 100" should read --100--.

COLUMN 22

Line 5, Magnetic" should read --¶ Magnetic--.
Line 7, "elements" should read --element--.
Line 8, "elements" should read --element--.
Line 27, "elements" should read --element--.
Line 33, "elements" should read --element--.
Line 39, "elements" should read --element--.
Line 50, "elements" should read --element--.

COLUMN 25

Line 5, "Bndr" should read --Binder--.

COLUMN 27

Line 22, "5.8" should read --4.8--.

UNITED STATES PATENT AND TRADEMARK OFFICE

CERTIFICATE OF CORRECTION

PATENT NO. : 5,858,593

DATED : January 12 ,1999

INVENTOR(S) : OSAMU TAMURA ET AL.

It is certified that error appears in the above-identified patent and that said Letters Patent is hereby corrected as shown below:

COLUMN 33

Line 12, "1.40 1.40" should read --1.42 1.38--.

COLUMN 34

Line 33, "elements" should read --element--.
Line 34, "elements" should read --element--.

COLUMN 35

Line 61, "elements" should read --element--.
Line 62, "elements" should read --element--.

COLUMN 37

Line 44, "magnetic," should read --magnet--.

UNITED STATES PATENT AND TRADEMARK OFFICE

CERTIFICATE OF CORRECTION

PATENT NO. : 5,858,593

DATED : January 12, 1999

INVENTOR(S) : OSAMU TAMURA ET AL.

It is certified that error appears in the above-identified patent and that said Letters Patent is hereby corrected as shown below:

COLUMN 38

Line 2, "elements" should read --element--.
Line 3, "elements" should read --element--.

Signed and Sealed this

Sixteenth Day of November, 1999

*Attest:*

Q. TODD DICKINSON

*Attesting Officer*

*Acting Commissioner of Patents and Trademarks*